US011071394B2

(12) United States Patent
Scarleski

(10) Patent No.: US 11,071,394 B2
(45) Date of Patent: Jul. 27, 2021

(54) SINGLE COVER PASSIVE MATTRESS SPINNER

(71) Applicant: Levitation Sciences LLC, Chicago, IL (US)

(72) Inventor: William John Scarleski, Chicago, IL (US)

(73) Assignee: Levitation Sciences LLC, Chicago, IL (US)

( * ) Notice: Subject to any disclaimer, the term of this patent is extended or adjusted under 35 U.S.C. 154(b) by 790 days.

(21) Appl. No.: 15/791,723

(22) Filed: Oct. 24, 2017

(65) Prior Publication Data

US 2018/0263376 A1 Sep. 20, 2018

Related U.S. Application Data

(60) Division of application No. 14/789,127, filed on Jul. 1, 2015, now abandoned, which is a continuation-in-part of application No. 13/628,427, filed on Sep. 27, 2012, now Pat. No. 10,123,630, which is a continuation-in-part of application No. 12/772,386, filed on May 3, 2010, now abandoned.

(51) Int. Cl.

| | |
|---|---|
| ***A47G 9/02*** | (2006.01) |
| ***A47C 21/00*** | (2006.01) |
| ***A47C 31/10*** | (2006.01) |
| ***A47C 21/02*** | (2006.01) |

(52) U.S. Cl.

CPC ..... *A47C 21/00* (2013.01); *A47C 21/028* (2013.01); *A47C 31/105* (2013.01); *Y10S 5/926* (2013.01); *Y10T 29/49817* (2015.01); *Y10T 29/49826* (2015.01); *Y10T 29/49947* (2015.01)

(58) Field of Classification Search

CPC ..... A47G 9/0292; A47G 9/02

See application file for complete search history.

(56) References Cited

U.S. PATENT DOCUMENTS

| | | | | | |
|---|---|---|---|---|---|
| 2,499,698 | A | * | 3/1950 | Thomas | A47C 31/105 5/499 |
| 3,829,914 | A | * | 8/1974 | Treat | A61G 7/1026 5/81.1 T |
| 3,849,813 | A | * | 11/1974 | Neilson | A47G 9/0238 5/495 |
| 5,628,077 | A | * | 5/1997 | Briganti | A47G 9/0246 5/496 |
| 5,632,054 | A | * | 5/1997 | Hutton | A47C 31/08 5/692 |

(Continued)

*Primary Examiner* — Peter M. Cuomo
*Assistant Examiner* — Ifeolu A Adeboyejo
(74) *Attorney, Agent, or Firm* — SmithAmundsen LLC

(57) ABSTRACT

A system is disclosed for facilitating rotation of a mattress in a horizontal plane carried by a box spring or a platform. Surfaces between the mattress and the box spring or platform are selectively placed in engagement with each other. The surfaces may be provided by two separate covers; a single cover and the inherent surface roughness of the box spring or fixed or adjustable platform; a single cover with an embedded surface or no covers with embedded surfaces in both the mattress and the box spring or platform. In the latter embodiment, the mattress and the box spring or platform are secured together in a normal mode of operation to prevent unintended movement of the mattress.

20 Claims, 21 Drawing Sheets

(56) References Cited

U.S. PATENT DOCUMENTS

| | | | | |
|---|---|---|---|---|
| 7,155,763 | B2 * | 1/2007 | North | A41B 13/06 5/482 |
| 7,836,528 | B2 * | 11/2010 | Nuckton | A47G 9/0238 5/81.1 HS |
| 7,849,533 | B1 * | 12/2010 | Receveur | A61G 7/0504 5/81.1 HS |
| 7,975,330 | B2 * | 7/2011 | Receveur | A61G 7/05784 5/81.1 HS |
| 9,693,919 | B2 * | 7/2017 | Berman | A61G 7/1023 |
| 2004/0226089 | A1 * | 11/2004 | Miranda | A47C 23/00 5/482 |
| 2007/0022533 | A1 * | 2/2007 | Borino | A47G 9/0284 5/493 |
| 2008/0301876 | A1 * | 12/2008 | Kenalty | A61G 1/01 5/620 |

* cited by examiner

SINGLE COVER PASSIVE MATTRESS SPINNER

CROSS REFERENCE TO RELATED APPLICATIONS

This application is a continuation-in-part of U.S. patent application Ser. No. 13/628,427, filed Sep. 27, 2012, which, in turn, is a continuation-in-part of U.S. patent application Ser. No. 12/772,386, filed on May 3, 2010, hereby incorporated by reference.

BACKGROUND OF THE INVENTION

1. Field of the Invention

The present invention relates to a system for facilitating the rotation of a top mattress in a horizontal plane with respect to a box spring or lower mattress and more particularly to a system which allows rotation of a top mattress in a horizontal plane with minimal effort in order to relocate worn or depressed portions of the mattress in order to even out the overall wear of the mattress.

2. Description of the Prior Art

A conventional bed includes a box spring or bottom mattress and an upper mattress. The box spring is normally carried by a bed frame which, in turn, carries a top mattress, which ends up being suspended about 13-16 inches from the floor. The top mattress (hereinafter "mattress") may be placed on top of the box spring or alternatively placed upon a platform forming a platform bed. In both applications, the mattress is held in place by friction and its weight.

Various types of mattresses are known. For example, U.S. Pat. Nos. 7,617,556 and 7,644,671 disclose conventional mattresses. Such conventional mattresses include a "casing" which is formed from material for holding the internal components of the mattress. The casing includes a bottom panel and four (4) vertical panels connected to the periphery of the bottom panel forming an open top container. In one such conventional mattress, a spring core is disposed in the container and rests against the bottom floor and fits snugly against the vertical panels. One or more layers of foam padding is placed on top of the spring core and covered with a top cover which is secured to the vertical panels.

In other known mattresses, a foam core is used in place of the spring core. Other known mattresses are known to include a so-called "pillow-top". The pillow top is generally formed as a comforter secured to the top cover and filled with cotton or some type of fibrous material.

A problem with the various types of mattresses, as discussed above, is that over time the mattress materials lose their resiliency causing body depressions to develop. In order to even out the wear in the mattress, it is known to rotate the mattress in the horizontal plane to relocate the body depressions, as shown for example, in FIGS. 1 and 2. Depending on the size of the mattress, one or two people may be required to rotate the mattress. For example, king and queen size mattresses may likely require two people to rotate the mattress, as shown in FIG. 1, while full and twin size mattresses can likely be rotated by a single person, as shown in FIG. 2.

Mattresses are relatively heavy items. The weight of a mattress varies as a function of the coil core, the gauge of the coil and the type of foam material used. An average king size mattress weighs between 85 and 115 pounds. High end king size mattresses with latex or memory foam can weigh as much as 300 pounds (http://www.mattressdirectionline-.com).

In order to rotate a mattress, the mattress must first be lifted and then rotated, as such, rotating a mattress is hard work. Depending on the weight of the mattress, rotating a mattress can be virtually impossible for some people, such as senior citizens, as well as people that are handicapped or disabled and others.

In order to address this problem, mattresses with removable pillow tops have been developed. An example of such a mattress is disclosed in U.S. Pat. No. 5,414,882. The '882 patent discloses a mattress with a pillow top that is secured to the top cover of the mattress by way of a zipper. With such a configuration, the pillow top can be relatively easily rotated by unzipping the pillow top, rotating it and zipping the pillow top back in place. While such a configuration enables body depressions in the pillow top to be relocated, it has no effect on body depressions that result in the mattress itself. Thus there is a need for a system to facilitate rotation of a mattress.

SUMMARY OF THE INVENTION

Briefly, the present invention relates to a system for facilitating rotation of a mattress in a horizontal plane carried by a box spring or a fixed or adjustable platform, (hereinafter individually or collectively referred to as a "foundation"). In order to facilitate rotation, a single cover is provided having a slick surface on one side and a non-slick surface on an opposing side. The surface of the mattress, box spring or platform is selectively placed in engagement with a slick surface of the cover. The invention relies on the inherent surface roughness of the mattress, box spring or platform to cooperate with the single cover. In a normal mode of operation, the cover is attached to the mattress so that the slick surface is in contact with the mattress and the non-slick surface is in contact with the foundation. In a rotate mode of operation, the cover is attached to the foundation so that the non-slick surface is in contact with the foundation and the slick surface is in contact with the underside of the mattress to enable the mattress to rotate relatively easily. After the mattress is rotated, the cover is re-attached to the mattress to prevent unintentional rotation.

DESCRIPTION OF THE DRAWING

These and other advantages of the present invention will be readily understood with reference to the following specification and attached drawing wherein.

DETAILED DESCRIPTION

Figure 21:
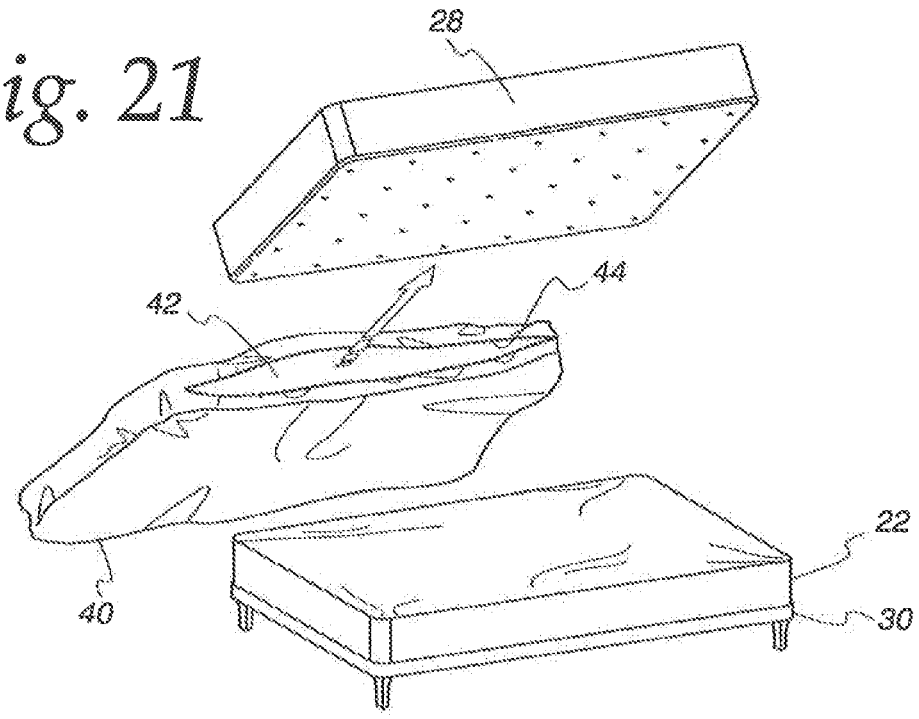
FIG. 21 illustrates an alternate embodiment of a two cover embodiment illustrated in FIGS. 3-5 in which the mattress cover is a protective cover having at least one slick surface, shown with the protective cover removed from the mattress and the mattress suspended relative to the foundation.
Figure 22:
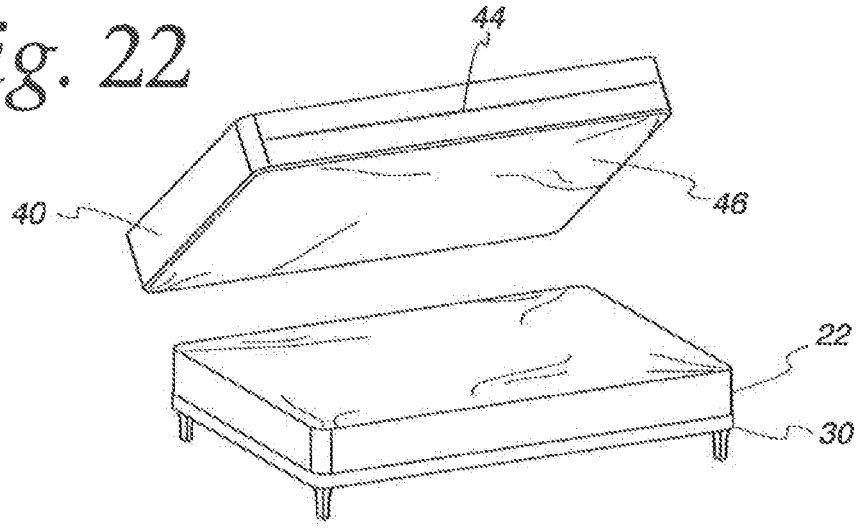
FIG. 22 is similar to FIG. 21 but shown with the protective cover installed on the mattress.
Figure 38:
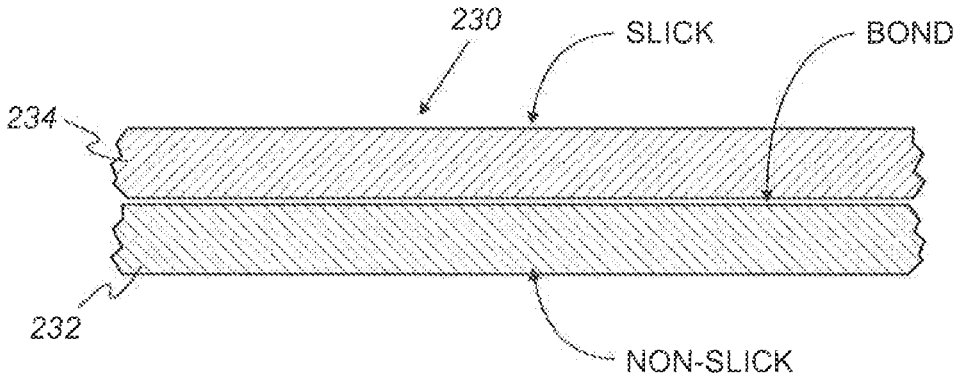
FIG. 38 is a partial sectional view of bonded multiple ply material used as a cover.
Figure 39:
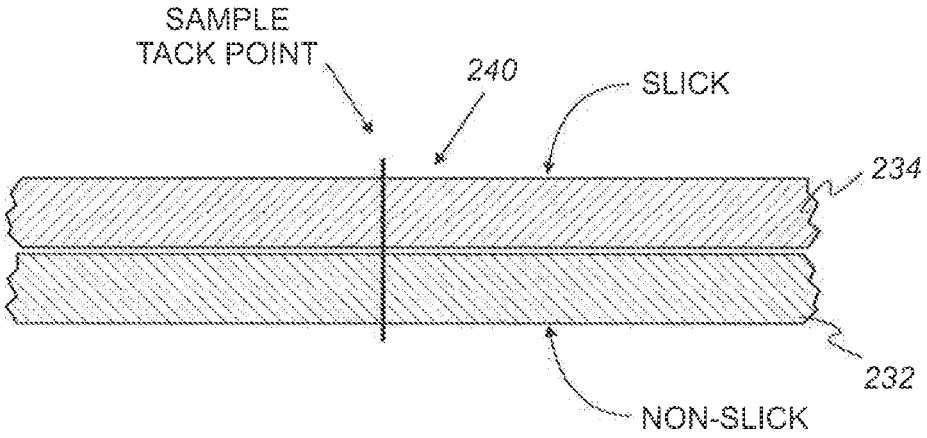
FIG. 39 is a partial sectional view of a cover formed from multiple plies material tacked together at one or more tack points so that the multiple plies function as a single piece of material.
Figure 40:
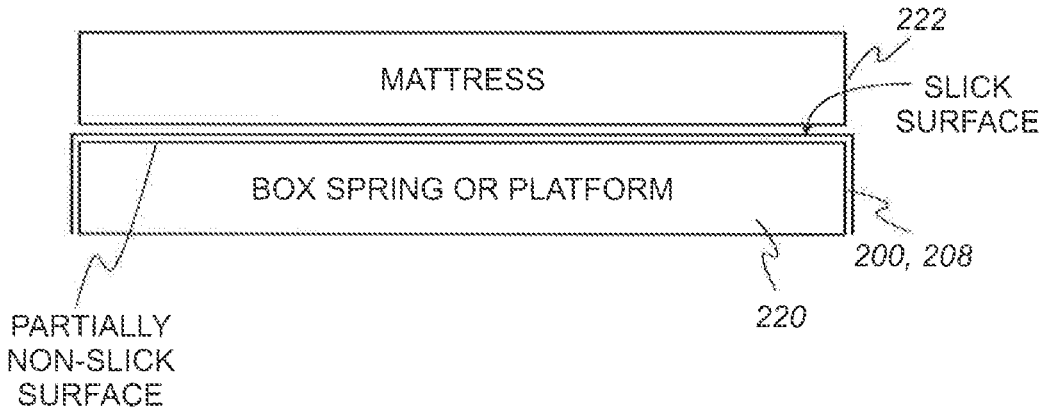
FIG. 40 is an elevational view of a mattress supported by a foundation shown with a cover as illustrated in FIGS. 34-37*b* disposed therebetween, shown in with the side panels folded up for attachment to the sides of the mattress in a rotate mode of operation.
Figure 41:
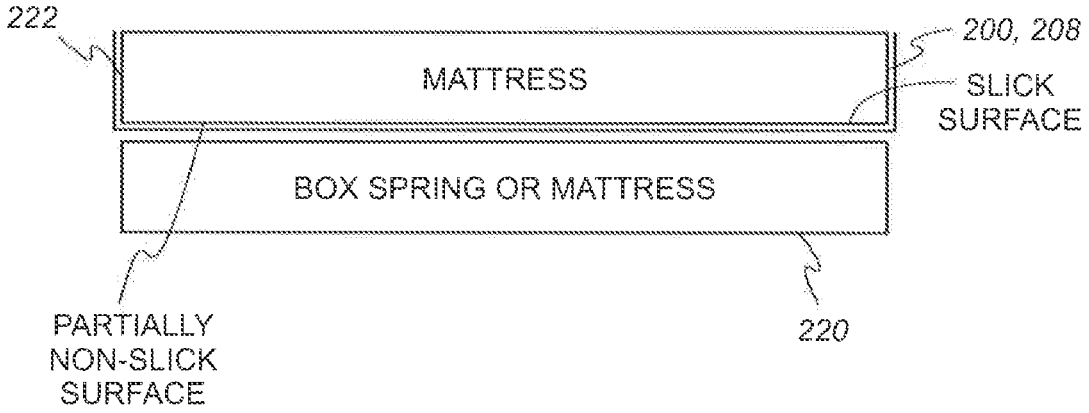
FIG. 41 is similar to FIG. 40 but shown with the side panels folded down for attachment to the sides of a foundation in a normal mode of operation.

The present invention relates to mattress rotation system for facilitating rotation of a mattress in a horizontal plane with respect to a foundation. Various embodiments of the invention are described and illustrated. In all embodiments, surfaces between the mattress and the foundation are selectively placed in engagement with each other. The surfaces may be provided by two separate covers, for example, as described and illustrated in connection with FIGS. 3-11. Alternately, a single cover embodiment relies on the inherent friction or inherent surface friction of the box spring or fixed or adjustable platform. A single ply embodiment is described below and illustrated in connection with FIGS. 25, 26, 29, 30, 32, and a multiple ply embodiment is illustrated in FIGS. 34-37*b*. An embodiment with no covers, i.e. coverless embodiment, with embedded surfaces in both the mattress and the platform is illustrated in FIGS. 13-20. In the latter embodiment, the mattress and the foundation are secured together in a normal mode of operation to prevent unintended movement of the mattress FIGS. 21 and 22 illustrate an embodiment with a protective cover. FIGS. 34-39 illustrate alternate embodiments of a single or two cover embodiments incorporating a multiple ply cover. FIGS. 40 and 41 illustrate a multiple ply single cover in a rotate mode and a normal mode.

Figure 1:
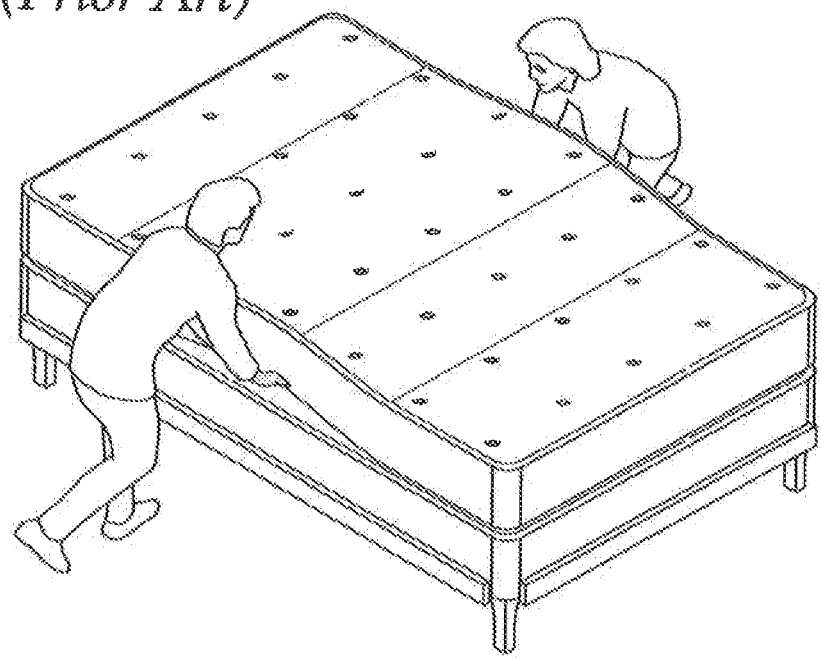
Fig. 1 (Prior Art)
FIG. 1 is an isometric drawing illustrating two people lifting a mattress carried by a foundation in an attempt to rotate the mattress in a horizontal plane in a conventional manner.
Figure 2:
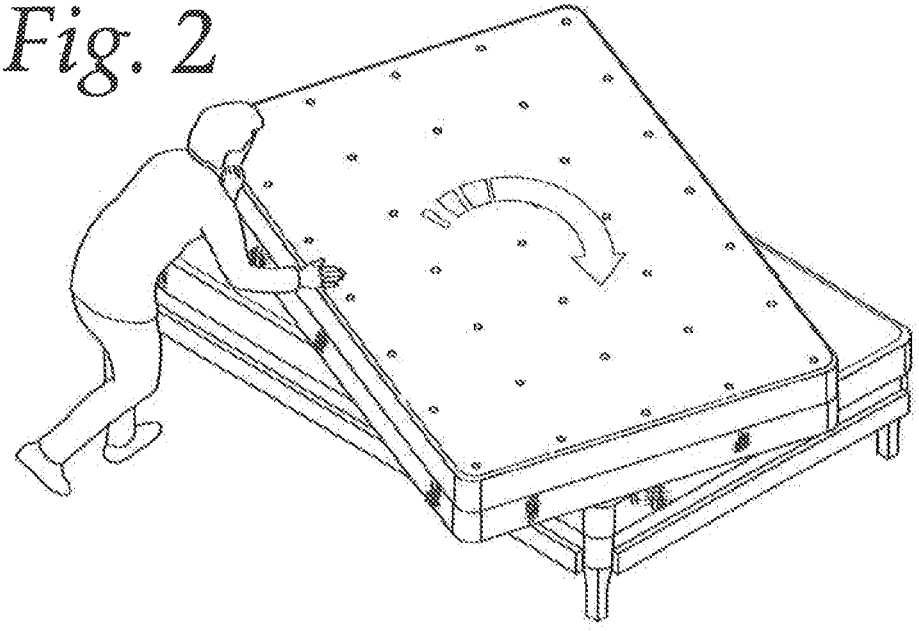
FIG. 2 is an isometric view of a two-cover embodiment illustrating one person rotating a mattress in accordance with the present invention, shown with the mattress carried by a foundation and also shown with the mattress partially rotated.
Figure 3:
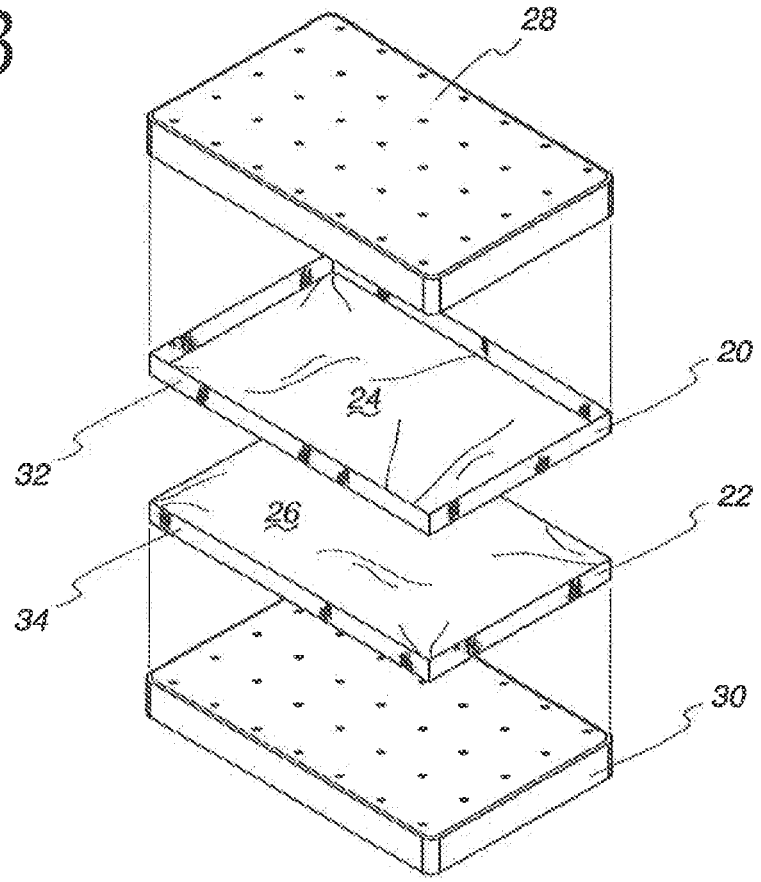
FIG. 3 is an exploded isometric view of one embodiment of the invention illustrating a conventional foundation and a conventional mattress and two covers in accordance with the present invention.
Figure 12:
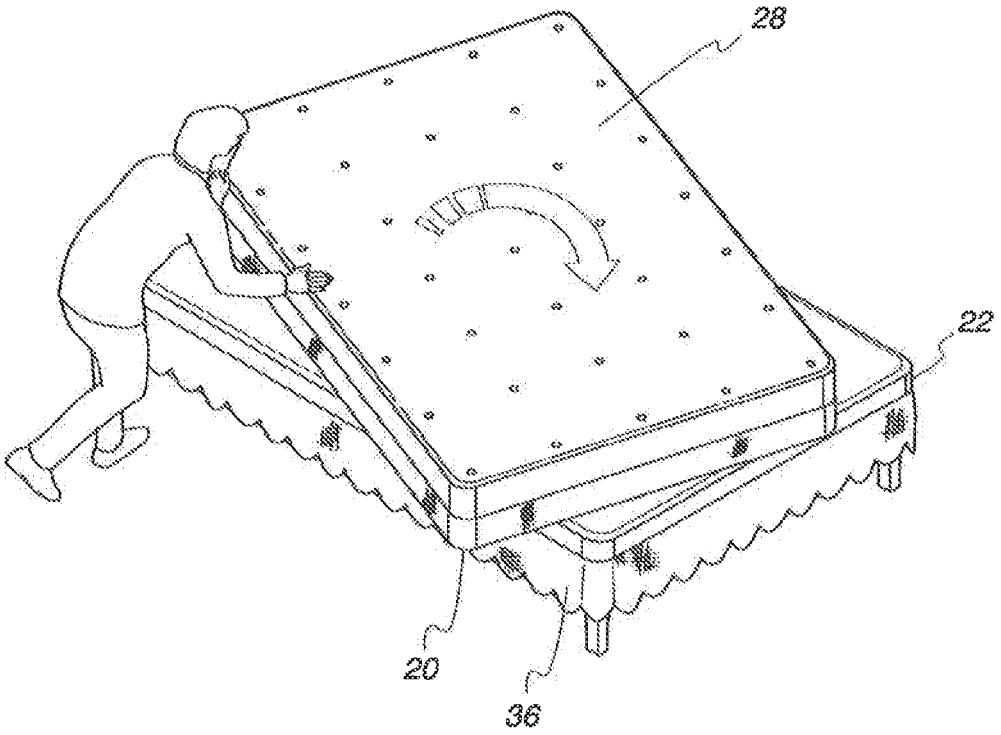
FIG. 12 is an isometric view of the two-cover embodiment illustrating one person rotating a mattress in accordance with the present invention shown with the mattress carried by a platform and also shown with the mattress partially rotated.
Figure 27:
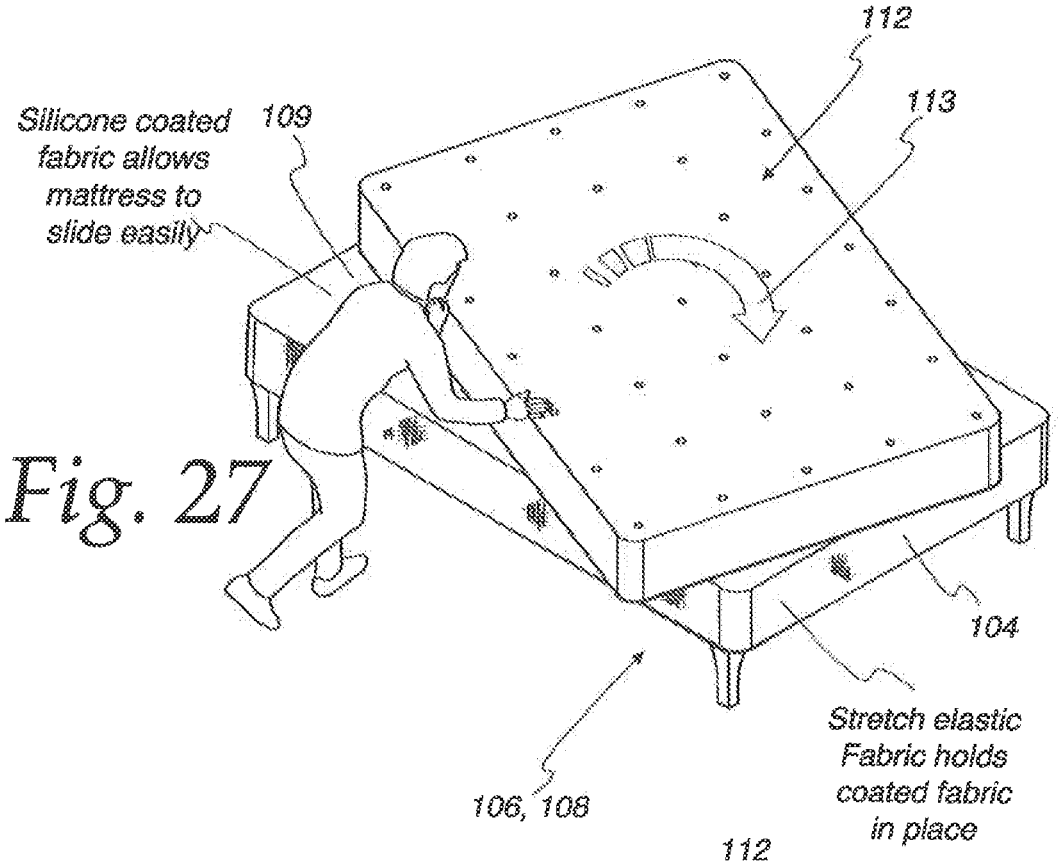
FIGS. 27 and 28 illustrate rotation of a mattress in accordance with the present invention relative to the platform with the cover illustrated in FIG. 26.
Figure 28:
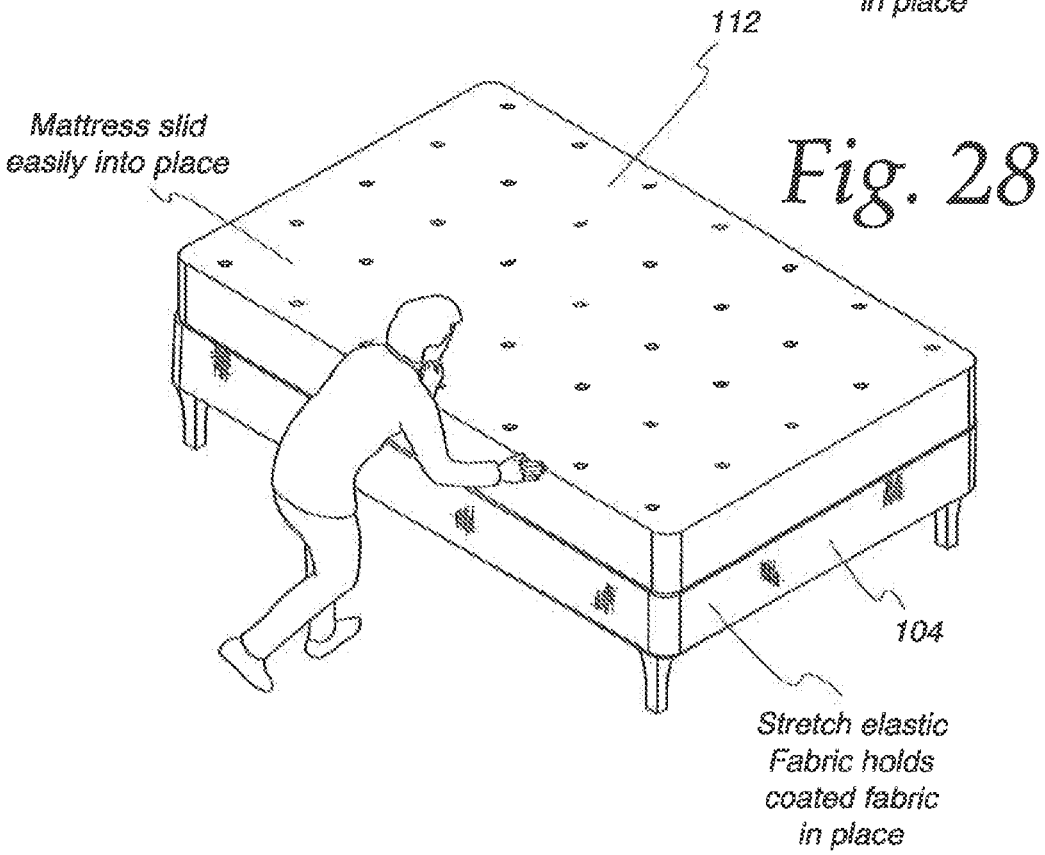

FIG. 2 illustrates rotation of a mattress with a two-cover embodiment. FIG. 12 illustrates rotation of a mattress with respect to a fixed or adjustable platform with a two-cover embodiment in which the foundation is covered by a bed skirt. FIGS. 27 and 28 illustrate rotation of a mattress with a single ply single cover, FIG. 3 illustrates rotation of a mattress with a multiple ply single cover

Single Cover Embodiments

There are multiple embodiments of the single cover mattress rotation system. In all embodiments, the single cover may be formed from a single ply or multiple plies. In one embodiment of the invention, a single cover formed from a single or multiple plies may be used to facilitate rotation of a mattress in a horizontal plane with respect to a foundation. In one embodiment, a slick surface is embedded in a top surface of the foundation. In an alternate embodiment, the invention relies on the inherent surface roughness of either the underside of the mattress or a top surface of the foundation.

Embedded Stick Surface

In addition to the embodiments discussed below which require two covers, alternate embodiments are discussed below which require only one cover. For example, one of the covers 20, 22 (FIGS. 3-11) may be eliminated and a slick surface embedded into a top surface of the box spring or platform or an underside of the mattress. In one exemplary embodiment, the foundation includes an integral or embedded slick surface facing upwardly and that is configured to contact an underside of the mattress. In an embodiment in which the slick surface is embedded in a top surface of the foundation, a single cover 20, as described below, may be attached to the underside of the mattress such that the slick surface faces downwardly and the non-slick surface is in contact with the underside of the mattress in a rotate mode of operation, the slick surface of the cover 20 is in contact with the slick surface integrally formed in the top surface of the foundation. Once the mattress is rotated and in the desired location, the cover 20 is attached to the foundation so that the two slick surfaces are in contact with each other and the non-slick surface is in contact with underside of the mattress defining a normal mode of operation. Alternatively, the slick surface can be embedded into mattress

Alternative Single Cover Embodiment

In this embodiment, a single cover can be used with either two (2) slick sides or one slick side and one non-slick side from a single or multiple plies. In such an embodiment, the invention relies on the inherent surface roughness and friction of either the underside of the mattress 28 or a top side of the foundation. In an embodiment with a cover having two slick surfaces, the cover is attached to either the underside of the mattress 28 or a top side of the foundation and remains in place during both a rotate mode and a normal mode. Additional means, as discussed below, are provided to secure the mattress with respect to the box spring or mattress to prevent unintended movement of the mattress.

An alternative embodiment of the single or multiple ply single cover invention utilizes a cover having a slick side and a non-slick side, the cover is attached to either an underside of the mattress or a top side of the foundation. In this embodiment, the invention relies on the inherent surface roughness of either the underside mattress or a top side of the foundation. For example, in a normal mode of operation, the cover may be attached to an underside of the mattress so that its non-slick side faces outwardly and contacts the inherent surface roughness of a top surface of the foundation to prevent unintended movement of the mattress with respect to the foundation. In a rotate mode of operation, the cover is attached to a top side of the foundation so that the slick surface is in contact with the underside mattress and the non-slick side is in contact with a top side of the foundation. As mentioned above, in this embodiment, the invention relies on the inherent surface roughness of the underside of the mattress. The mattress is rotated and the cover is re-attached to the mattress.

Figure 29:
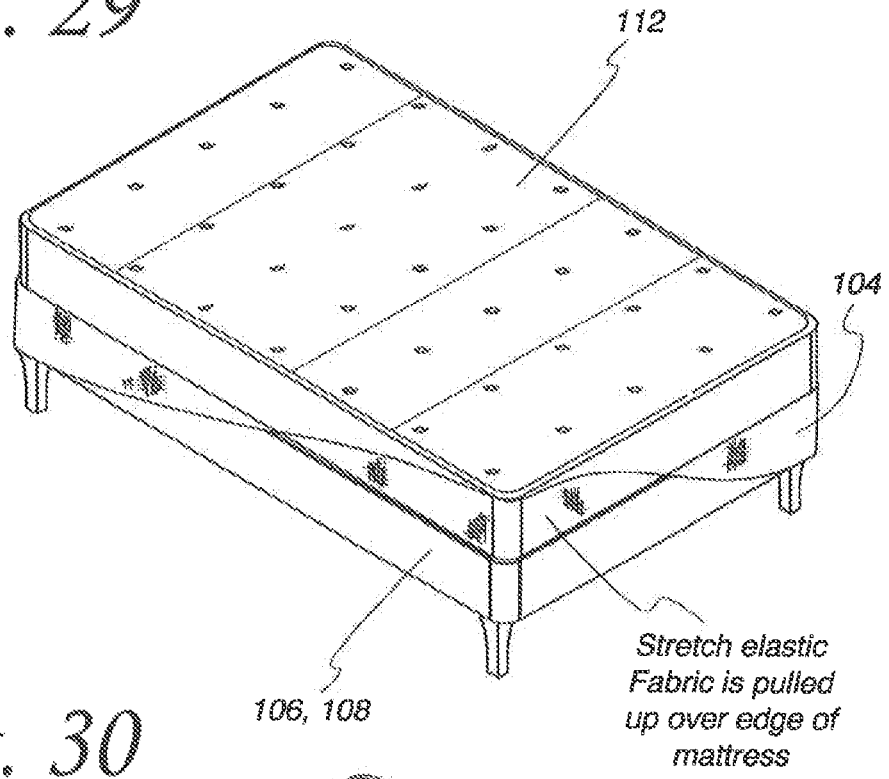
FIG. 29 is an isometric drawing of a mattress on a fixed or adjustable platform with a single cover in which the cover, illustrated in FIG. 26 is partially turned up and attached to the mattress.
Figure 30:
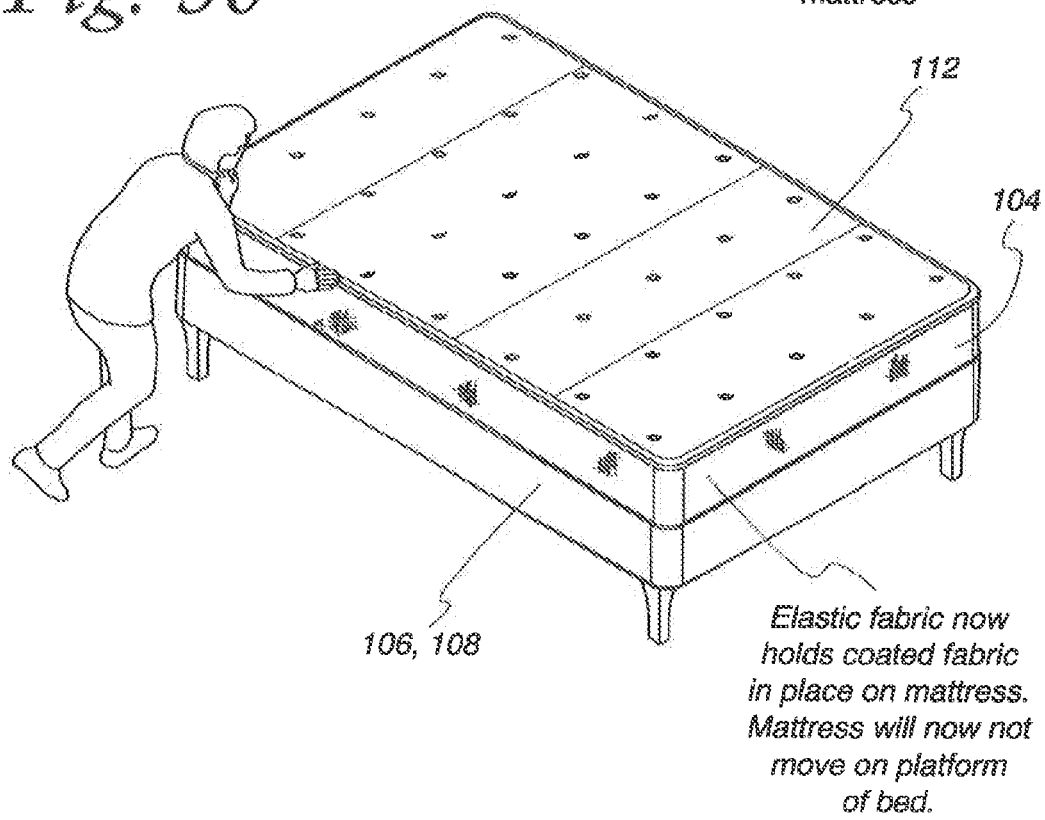
FIG. 30 is similar to FIG. 29 but illustrating the cover fully attached to the mattress illustrating a normal mode of operation.
Figure 31:
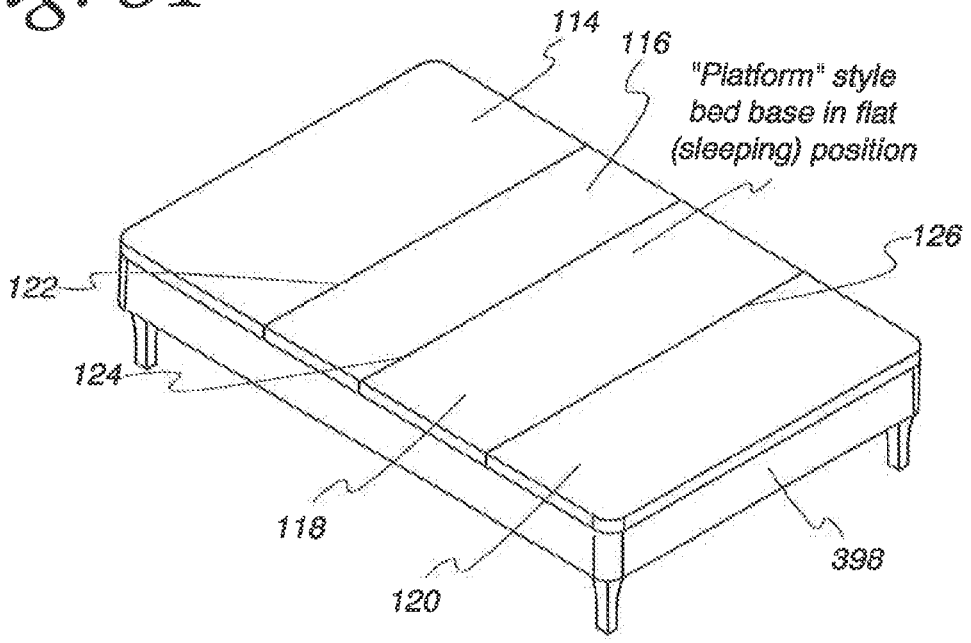
FIG. 31 is an isometric view of an adjustable platform, shown in a flat position.
Figure 32:
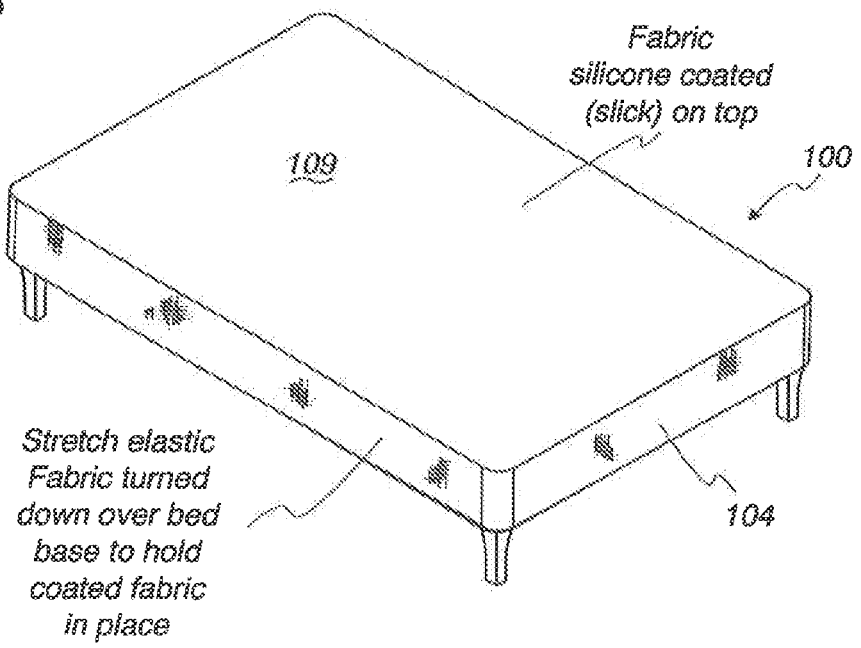
FIG. 32 is similar to FIG. 31 but shown with a single cover in accordance with the present invention attached to the adjustable platform.
Figure 33:
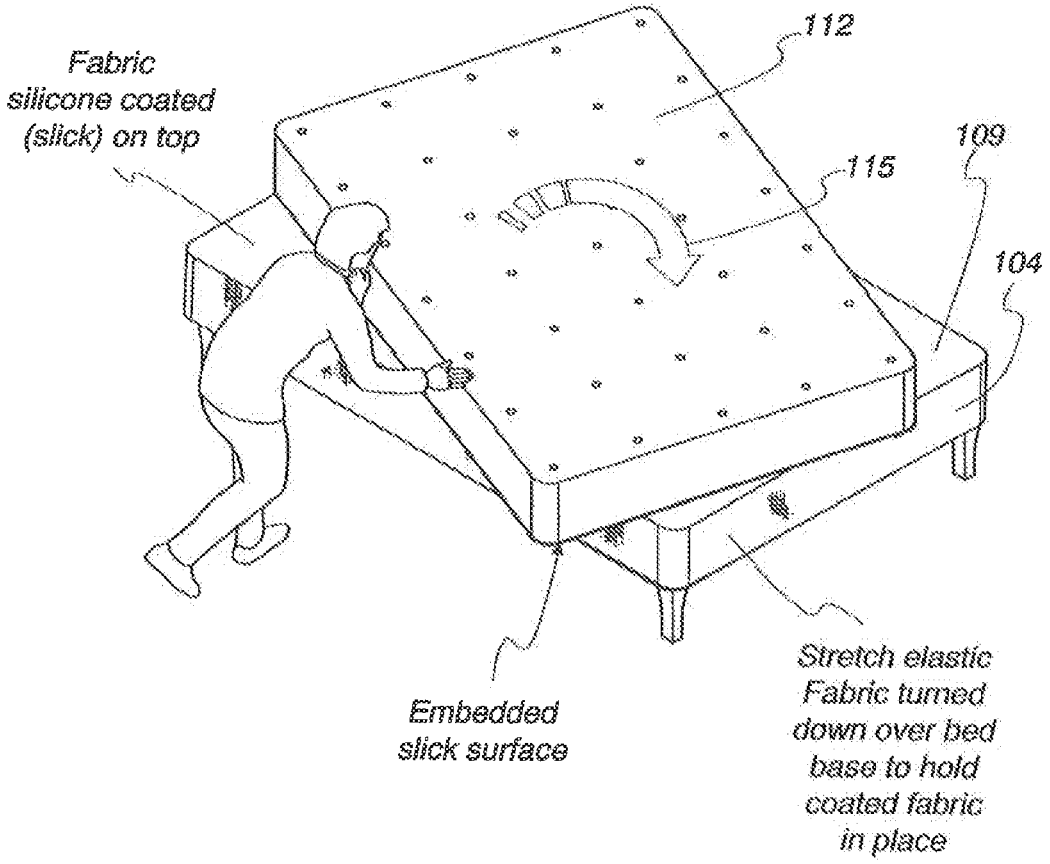
FIG. 33 is an isometric view of a one-cover embodiment as illustrated in FIG. 32 which illustrates rotation of a mattress in accordance with the present invention relative to the adjustable platform.

Other exemplary embodiments of the invention are described below and illustrated in FIGS. 25-33. In the exemplary embodiment shown, FIGS. 25-30 illustrate an embodiment of the invention on a fixed platform. FIGS. 31-33 illustrate an embodiment of the invention on an adjustable platform.

Figure 25:
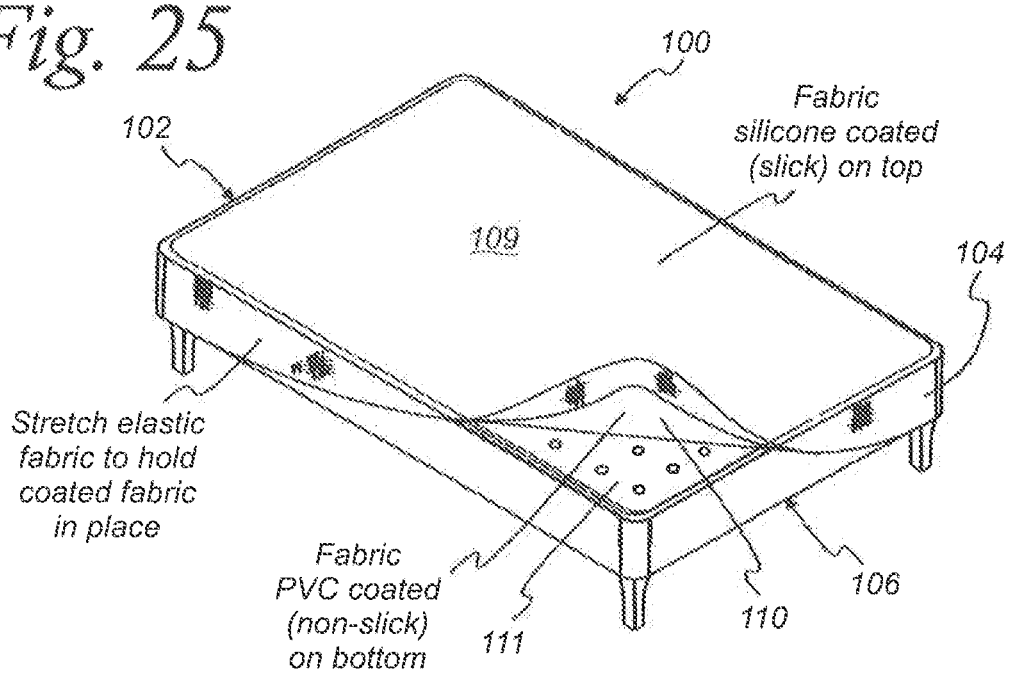
FIG. 25 is an isometric drawing illustrating an embodiment of the invention over a platform utilizing a single cover, shown with one corner turned up.
Figure 26:
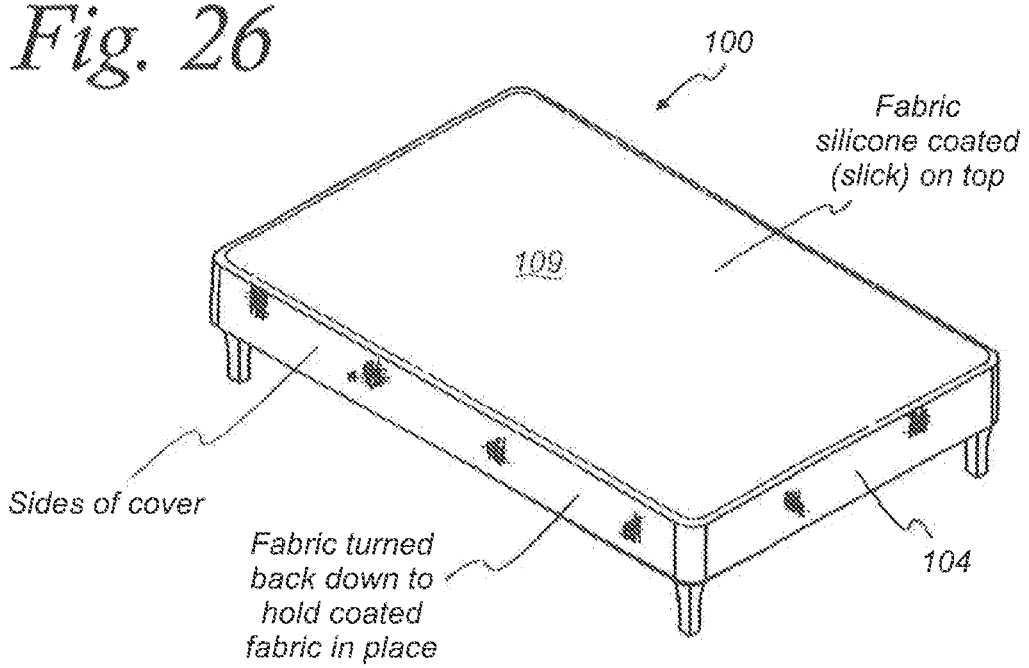
FIG. 26 is similar to FIG. 25 shown with the cover fully attached to the platform illustrating a rotate mode of operation.

As illustrated in FIGS. 25 and 26, the cover, generally identified with the reference numeral 100, includes a horizontal panel portion 102, which may be rectangular or another shape. An attachment portion may be used to attach the horizontal panel portion 102 to the sides of a foundation 106 or mattress 112. The attachment portion may be implemented as a side panel portion 104, as discussed below, or various other means, also discussed below and virtually any means for removably attaching the horizontal panel portion 102 of the cover 100 with respect to the sides of the foundation 106 or mattress 112. The horizontal panel portion 102 of the cover 100 is formed to fit the foundation including a fixed platform 106 or an adjustable platform 108 (FIG. 31).

Various embodiments of horizontal panel portion 102 and the side panel portion 104 for both the single cover and two cover embodiments. For example, the side panel portions 104 can be formed from a continuous piece of material and attached to at least a portion of the periphery of the horizontal panel portion 102. Alternatively, the side panel portions 104 can be discontinuous and formed from multiple pieces of material and attached to at least a portion of the periphery of the horizontal panel portion 102.

In addition, one or more side panel portions 104 can at least be partially formed from the horizontal panel portion 102. In other words, the horizontal panel portion 102 is sized to cover a top side or underside of a mattress 112 (FIG. 27) and one or more side panel portions 104 The horizontal panel portion 102 and one or more of the side panel portions 104 may be formed from the same or different materials including conventional bedding fabrics and conventional decorative bedding fabrics. Both the horizontal panel portion 102 and the side panel portions 104 may be formed from any stretchable or non-stretchable fabric.

In embodiments in which the side panel portion(s) 104 are formed separately from the horizontal panel portions 102, the side panel portions 104 may be attached to the horizontal panel portion 102 by various conventional methods, such as stitching, bonding, heat sealing, sonic welding. Moreover, side panel portions 104 can be attached to the periphery of the horizontal panel portion 102 to form a single ply cover as illustrated, for example in FIG. 3 or a multiple ply cover as illustrated in FIGS. 35,35*a*, 35*b*, 36, 36A and 36B in which a portion of the side panel portions 109 overlap the horizontal panel portion 104 forming a multiple ply portion. In one embodiment, the side panel portion 104 may be continuous around the periphery of the horizontal panel portion 104. In that exemplary embodiment shown, at least a portion of the horizontal panel portion 102 or the entire horizontal panel portion 104 may be formed to include a slick surface 109 formed on at least a portion of one side 109 and may be formed to include a non-slick surface on at least a portion or the opposing side 111.

The horizontal panel portion 102 of the cover 100 may be formed from a 70D×70D 7210 nylon ripstop material or other material with similar non-elastic properties. The size of the horizontal panel portion 102 may be selected to be the same size as the horizontal portion 111 of the platform 106.

At least a portion of one side of the horizontal panel portion 102 may be coated to form a slick surface 109. The slick surface 109 may be provided by way of various coatings including a silicone coating or other coating providing a similar co-efficient of friction. The silicone coating is optional on the side 109. The inherent surface roughness of the material may be used alone as the side 109. At least a portion of the other side of the horizontal panel portion 102 may be formed with a non-slick surface 110. The non-slick surface 110 may be provided by various coatings including a polyurethane coating or a polyvinyl chloride (PVC) coating or other coating having. A similar co-efficient of friction. Alternatively, materials which inherently have a slick side and a non-slick side may be used without any coatings.

As mentioned above, the side panel portion 104 may be formed from any stretchable or non-stretchable fabric. For example, the side panel portion 104 may be formed from elastic materials including 90 gram, 2-way stretch 100% polyester material, otherwise known as Jersey Knit or other materials having similar elasticity properties. One side of the side panel portion 104 may optionally be coated with a non-slick coating, such as 1-2 mil of polyurethane or PVC. The optional coating is applied to a side that will be in contact with the platform 106.

The side panel portion 104 is attached around at least a portion of the perimeter periphery of the horizontal panel portion 102 in order to attach the horizontal panel portion 102 to the sides of the foundation, for example, the platform 106 or 108 (FIG. 31) as shown. In certain embodiments, the side panel portion 104 may be formed with a width generally equal to at least a portion of the width of the vertical portions forming the foundation, for example, the platform 106 or 108 (FIG. 31).

The function of the side panel portion 104 is to hold the horizontal panel portion 102 in place during maneuvering of the mattress 112 when the side panel portions 104 are disposed adjacent to the sides of the mattress 112 or alternatively disposed adjacent the sides of the foundation. In one embodiment, the side panel portions 104 may be formed from a stretchable material, such as elastic. In such an embodiment, the side panel portions 104 exert a compression force against the sides of the mattress 112 or alternatively exert a compression force against the sides of the foundation to hold the horizontal panel portion 102 in place. Other means can be used to hold the horizontal panel portion 102 in place relative to the foundation or alternatively with respect to the sides of the mattress. For example, various fasteners including Velcro fasteners, snaps, buttons and the like can be used. Also, straps can be used. All such devices are considered to be within the broad scope of the invention.

Single Ply Cover

In the embodiments illustrated in FIGS. 25 and 26, a single cover 100 is illustrated, made from a single ply of suitable material, as described below. In general, the cover 100 includes a slick surface 109 on at least a portion of one side and a non-slick surface 110 on at least a portion of an opposing side. Each side 109,110 of the cover 100 may be formed such that an entire side 109,110 is formed with a slick surface or a non-slick surface.

Multiple Ply Covers

Two different embodiments of multiple ply covers. For example, as illustrated in the exemplary embodiments in FIGS. 34-37*b*, the term "multiple plies" refers to a cover in which there is partial overlapping of the side panels 209 with respect to the horizontal panel 204. These multiple ply embodiments can be used in both the single cover and two cover mattress rotator systems discussed above discussed above.

Figure 34:
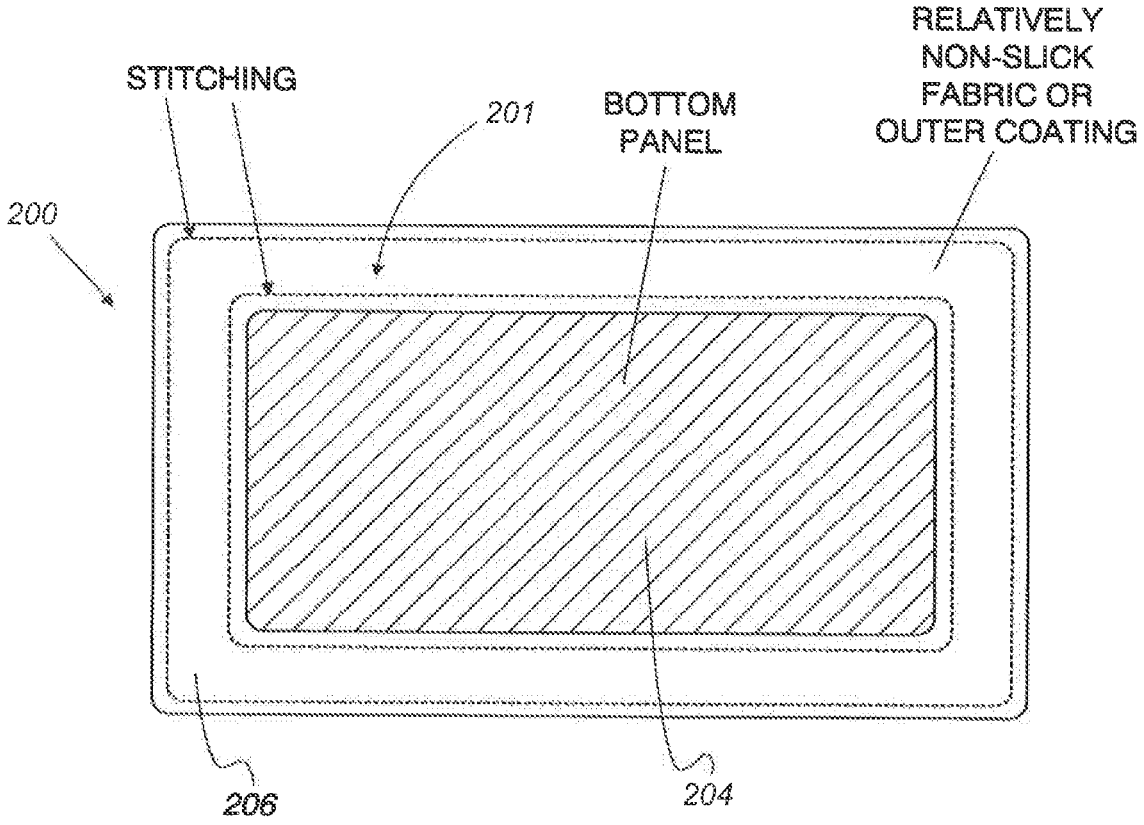
FIG. 34 is a plan view of an alternate embodiment of a single cover formed from multiple plies illustrating a slick surface that covers a portion on one side of the cover and is at least partially surrounded by a non-slick surface. In accordance with the present invention.
Figure 35A:
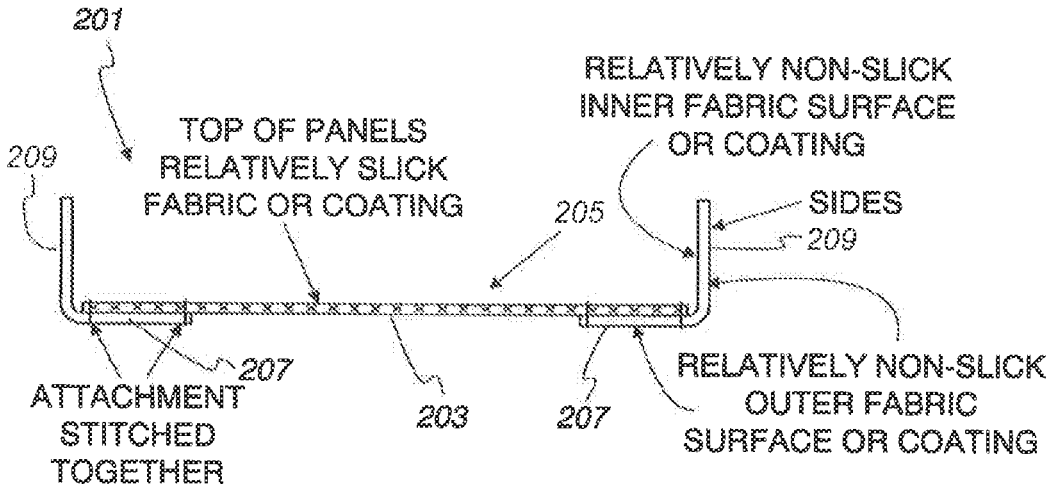
FIG. 35*a* is a section view of the cover illustrated in FIG. 34, shown with the side panels folded up for attachment to an underside of a mattress.
Figure 35B:
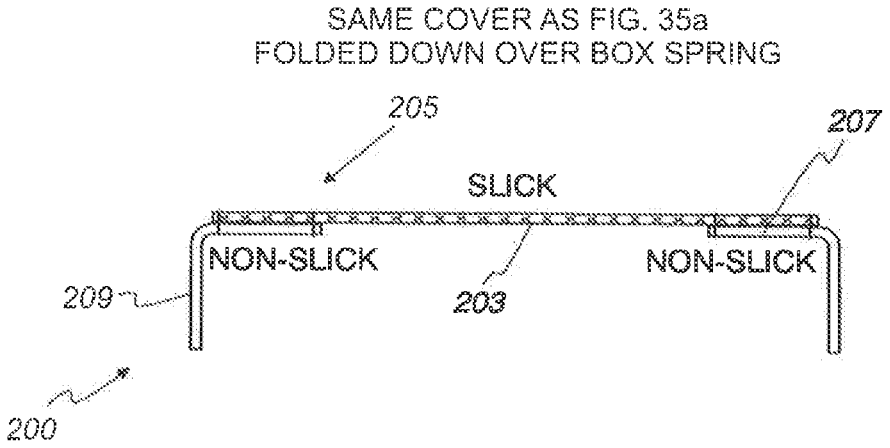
FIG. 35*b* is similar to FIG. 35*a* but shown with the side panels folded down for attachment to a foundation.
Figure 36:
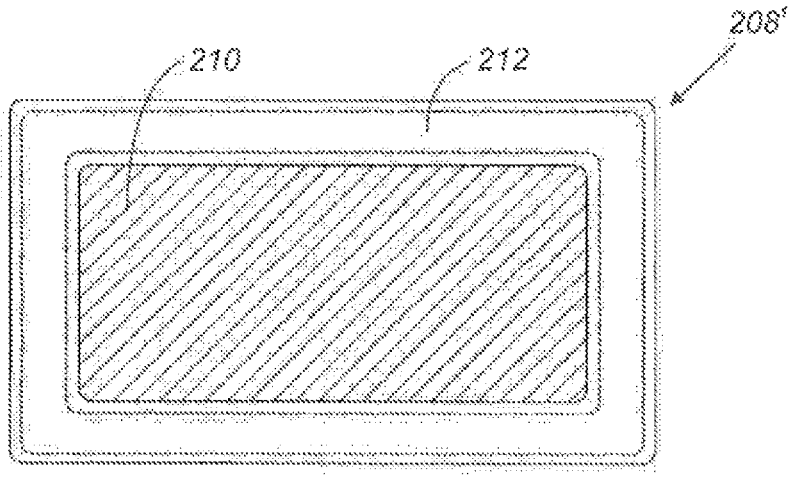
FIG. 36 is a plan view of another alternate embodiment of a single cover formed from multiple plies illustrating a non-slick surface that covers a portion of one side of the cover and is at least surrounded by a slick surface in accordance with the present invention.

Referring first to the embodiment depicted in FIGS. 35*a* and 35*b*, this embodiment illustrates that at least a portion of the cover 200 is formed from two (2) or more plies of material. In particular, the cover 200 includes a generally horizontal panel 204 and one or more side panels 209. As best shown in FIGS. 35*a* and 35*b*, the horizontal panel 204 and the side panels 209 are formed from separate pieces of material. FIGS. 35*a* and 35*b* illustrate that a portion of the side panels 209 overlaps the horizontal panel 204 forming a multiple ply in a portion of the cover 200. FIG. 34 illustrates one side of the multiple ply cover 200. As shown best in FIGS. 35*a* and 35*b*, the side panels 209 overlap a portion of the horizontal panel 204. Thus one side of the horizontal panel will be in the embodiment of the invention as illustrated 34, 35*a* and 35*b*. In the exemplary embodiment shown in FIGS. 34, 35*a* and 35*b*, one side 205 of the horizontal panel 204, i.e., the side with no overlap of the side panels 209 is formed with a slick surface. An opposing side 203 of the horizontal panel 204 is formed with a non-slick or slick surface. Both sides of the side panels 209 may be formed with non-slick surfaces. The non-slick and slick surfaces can be formed with or without a coating.

Figure 37A:
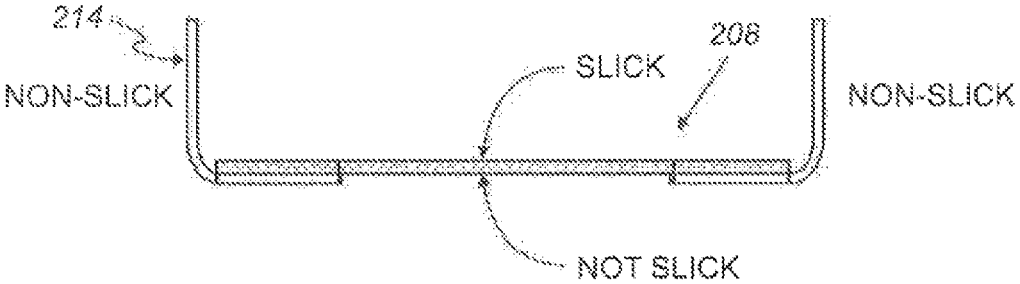
FIG. 37*a* is a section view of the cover illustrated in FIG. 36, shown with the side panels folded up for attachment to an underside of a mattress.
Figure 37B:
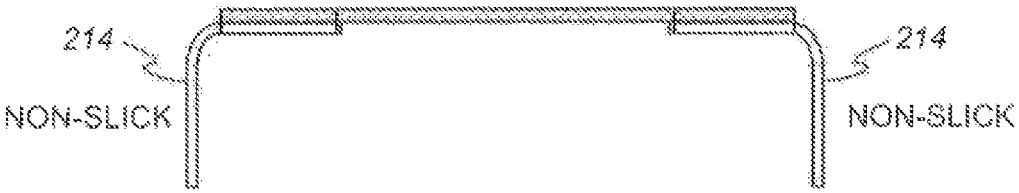
FIG. 37*b* is similar to FIG. 37*a* a but shown with the side panels folded down for attachment to a foundation.

FIG. 34 best illustrates an exemplary method for securing the side panels 209 to the horizontal panel 204. As shown, the overlapping portions of the side panels 209 may be stitched to the horizontal panel 204 by way of one or more stitch patterns. For example, two stitch patterns are shown. Other stitch patterns as well as other means for attachment are contemplated. For example, the side panels 209 may be attached to the horizontal panel 204 by way of being bonded, heat sealed, sonic welded, fastened, woven as well as any other conventional method for joining two pieces of material. For example, FIG. 38 illustrates an embodiment in which the overlapping portion of the side panel 214 is bonded to the horizontal panel 208. FIG. 39 illustrates another embodiment in which the overlapping portion of the side panel 214 is tacked to the horizontal panel 208 at one or more tack points 215. In an exemplary alternative embodiment illustrated in FIG. 36, the cover, generally identified with the reference numeral 208', includes an exemplary location for the non-slick portion. In particular, the non-slick portion, identified with the reference numeral 210, is disposed away from the edges of a rectangular panel, generally identified with the reference numeral 212 (FIG. 37). Although a generally rectangular shape is shown for the non-slick surface 210, other shapes are contemplated to be within the broad scope of the invention.

As shown in FIGS. 35*a*, 35*b*, the entire surface of one side of the cover 200, generally identified as a horizontal panel 207, sized to cover a mattress, a box spring or a platform is attached or integrally formed with a side panel 209. Similarly, as shown in FIGS. 37*a* and 37*b*, the entire surface of one side of the cover 208', namely the rectangular panel 212 may be sized to cover a mattress, a box spring or a platform and attached or integrally formed with a side panel 214.

Various embodiments of the side panels 209, 214 are contemplated. For example the side panel 209 (FIG. 35*a*) and the side panel 214 (FIG. 37*a*) may be made from a stretchable or non-stretchable material. The side panel 214 may also be formed from the same or different material as the horizontal panel and may be made from any of the materials described herein. Alternatively, the side panels 214 can be made from decorative material, for example, material that blends with the material used by the mattress factory to encase the mattress. All such embodiments are contemplated.

In addition, the side panels 209, 214 may be disposed around the entire periphery of the rectangular panels 207, 212 or a portion of it. The side panels 209, 214 may also be formed from the same material as the rectangular panels 207, 212, respectively, as illustrated in FIGS. 23*a*-24*c*, and described below. In addition, the side panels 209, 214 may be formed with continuously connected corners, for example, as shown in FIG. 25, or alternatively formed with open corners 25 as shown FIG. 23*a* and FIG. 24*a*. The open corners may be secured together by various conventional fastener methods, such as elastic strips 27 (FIG. 23*b*) or alternatively virtually any other fastener system, such as a Velcro® fastener strip system 29 and 31. Other types of methods are contemplated for securing the corners 25 and 25', such as loop and button systems and zippers, (not shown).

The corners 25 and 25' can also be sewn together. In this embodiment, the weight of the mattress in conjunction frictional forces between the non-slick surfaces on the cover relative to the inherent surface friction of the box spring or platform may be used to maintain the cover in place while the mattress is being rotated relative to the box spring or platform. In yet another embodiment, a draw string (not shown), as discussed below, may be provided along the bottom edge of the side wall 209 to secure the cover 200 relative to the mattress, box spring or platform.

Various other embodiments of the side panels 209 are contemplated. The side panels 209 can be formed from as an elastic band, as discussed below. Alternatively, the side panels 209 can be eliminated altogether. In such an embodiment, the rectangular panel 207 is attached directly to the mattress, box spring or platform by an appropriate fastener system, such as loop and button system, a zipper system or a Velcro fastener system. All such embodiments are considered to be within the broad scope of the invention.

FIGS. 40 and 41 illustrate the different modes of operation of the covers illustrated in FIGS. 34-37. FIG. 40 illustrates a rotate mode of operation. In this mode of operation, the cover 200,208 is attached to the box spring or platform 220. In this position, the slick surface 205, 212 will be in contact with the underside of a mattress 222. The non-slick surfaces will be in contact with a top surface of the box spring or platform 220. The mattress 222 is then rotated 180 degrees, for example, as shown in FIGS. 27 and 28.

Once the mattress 222 is maneuvered in place, the cover 200, 208 is returned to a normal position as illustrated in FIG. 41. In this position, the cover 200,208 is attached to the underside of the mattress 220. In this position, the slick side 207, 212 of the cover 200, 208 is in contact with the mattress 222 and the side with the non-slick portions 201,210 is in contact with a top surface of the box spring or mattress 220.

Mattress Maneuverings shown in FIGS. 25 and 26, in a rotate mode of operation, the cover 102 is attached to the platform 106 so that the non-slick surface 110 of the cover 102 is in contact with the horizontal portion 111 of the platform 106 defining a rotate mode of operation. If an optional coating, as discussed above, is applied to the side portion 104 of the cover 102, the optional coating (not shown) will be in contact with the vertical rails of the platform 106.

Referring to FIGS. 27-30, operation of the single cover embodiment is illustrated. FIGS. 27 and 28 illustrate a rotate mode of operation. In a rotate mode of operation, the cover 102 is attached to the platform 106 or 108 (FIG. 31). As mentioned above, in this mode of operation, the slick side 109 of the cover 100 is in contact with the underside of the mattress 112. As such, a user can rotate the mattress relatively effortlessly, as indicated by the arrow 113.

FIG. 28 illustrates the mattress 112 in place after rotation. After the mattress 112 is in place, the sides 104 of the cover 100 are attached to the mattress 112, as shown in FIGS. 29 and 30, illustrating a normal mode of operation.

Adjustable Platform

FIGS. 31-33 illustrate the application of the single cover embodiment to a bed with an adjustable platform 108 (FIG.

31). An exemplary platform 108 is illustrated in FIG. 31. The adjustable platform 108 includes a plurality of sections 114, 116, 118 and 120 which are movable about the various axes 122, 124 and 126. Various mechanical drives (not shown) are located beneath the platform 108 that enable the various sections to be adjusted by way of a controller (not shown). FIG. 31 illustrates the adjustable platform 108 in a sleep position in which all of the adjustable sections 114, 116, 118 and 120 are flat defining a sleep position.

The cover 100 functions on an adjustable platform 108 in the same manner as a fixed platform 106 (FIG. 25). In particular, the cover 100 is attached to the adjustable platform 109 with the adjustable platform in a sleep position. In a rotate mode of operation, as generally illustrated in FIG. 32, the cover 100 is attached so that the suck side 109 faces upwardly and contacts the underside of the mattress 112. The mattress 112 is rotated, for example, in the direction of the arrow 114, relatively easily. Once the mattress 112 is in position, as shown in FIG. 30, the cover 100 is attached to the mattress 112, as shown in FIGS. 29 and 30 defining a normal mode of operation.

Two Cover Embodiment

I In a two cover embodiment of the invention, as illustrated in FIGS. 3-11, the slick surfaces may be provided by two (2) separate covers; one cover for the mattress and one cover for the box spring or platform. One cover is provided with a slick and non-slick side. The other cover is provided with at least one slick side and may have two slick sides. In an alternate embodiment, as shown in FIGS. 21 and 22, one cover may be a protective cover that encapsulates the entire mattress and permanently exposes a slick surface relative to the box spring or platform. In another alternate embodiment, one cover may be provided that cooperates with a slick surface that is integrally provided on one or the other of the mattress or box spring or platform. In yet another alternate embodiment of the invention, as shown in FIGS. 12-20, slick surfaces may be provided on both the mattress and the box spring or platform. In this embodiment, in order to prevent movement of the mattress with respect to the box spring or platform, the mattress is secured relative to the box spring or platform by removable fasteners in a normal mode of operation.

In the embodiments illustrated in FIGS. 3-11 and 21-22 two (2) covers are provided which enable slick surfaces between the mattress and the box spring or platform to be selectively placed in contact with each other to reduce the normal friction therebetween to enable the mattress to be rotated in a horizontal plane without lifting the mattress. Alternate embodiments, operate on the same principle but require only one separate cover that cooperates with a slick surface integrated into one or the other of the mattress or box spring or mattress. In yet other embodiments of the invention, as illustrated in FIGS. 13-20, the slick surfaces on the mattress and box spring or platform are constantly in engagement with each other when the mattress is placed on top of the box spring or platform. In these embodiments, one or more fasteners are used to secure the mattress to the box spring or platform to prevent unintended movement therebetween in a normal mode of operation.

Figure 4:
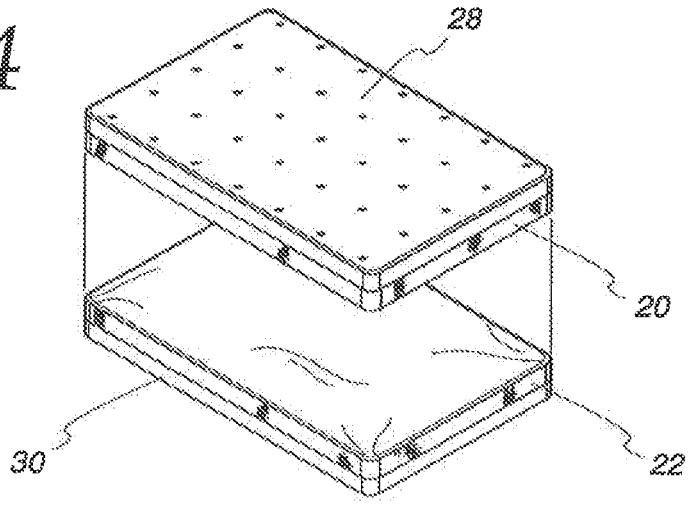
FIG. 4 is similar to FIG. 3 illustrating one of the covers shown in FIG. 3 installed on the mattress and one cover installed on the foundation.
Figure 5:
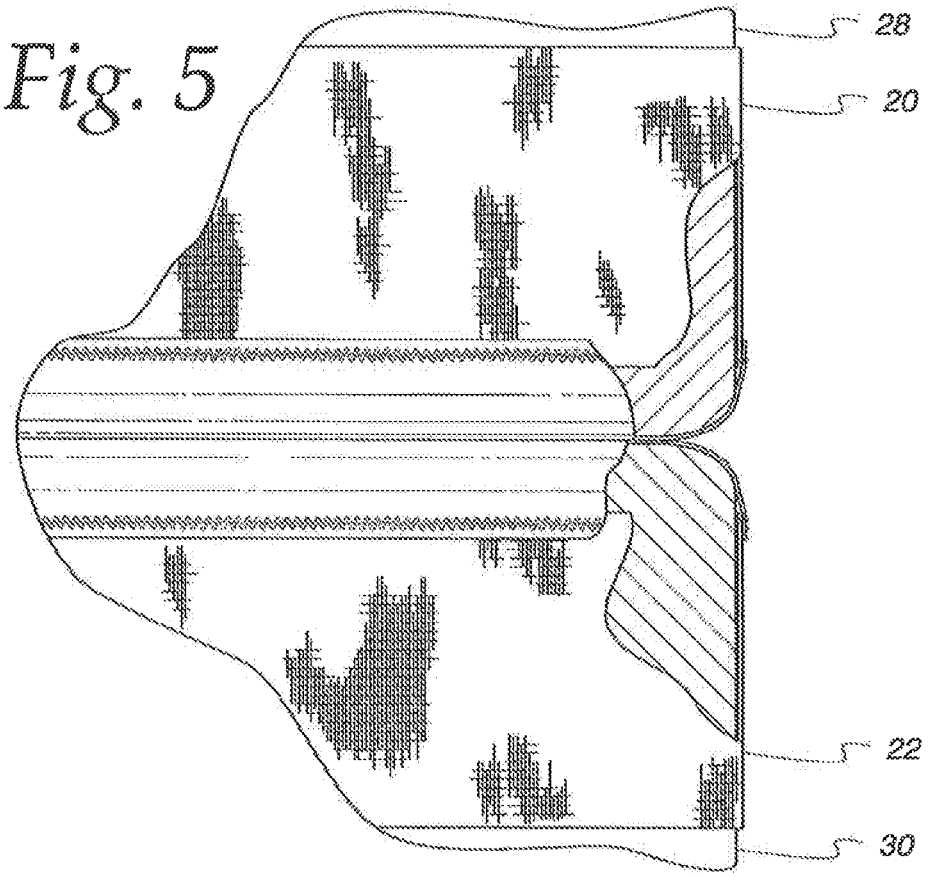
FIG. 5 is a partial side elevational view of the embodiment illustrated in FIG. 3, partially in section, illustrating one of the covers installed on the mattress and one cover installed on the foundation and shown in a rotate configuration in which the slick surfaces of the two covers are in contact with each other, securing the bed skirt into position prior to rotating.

Referring first to FIGS. 3-5, the invention comprises a first cover 20 and a second cover 22. The covers 20 and 22 each include a horizontal panel 24 and 26, respectively, configured to the size of a mattress 28 and a box spring 30. Each of the covers 20, 22 includes a side panel 32, 34, attached to at least a portion of the periphery of the panels 24, 26 respectively. The bands 32, 34, allow the covers 20, 22 be removably secured to the mattress 28 and the box spring 30, as generally shown in FIG. 4.

The side panels 32, 34 as well as the horizontal panels 24, 26 may be formed from stretchable or non-stretchable material. For example, an elastic material, for example, spandex and other stretchable materials, such as mesh or an elastic band can be used and attached to the horizontal panels 24, 26 respectively, for example, by sewing. Alternatively, the side panels 32, 34 can be formed from a mesh or stretchable fabric. The side panels 32, 34 can be formed from the same material or different material as the horizontal panels 24, 26 and secured to the mattress 28 and box spring or platform 30 by way of a drawstring (not shown) or other attachment method.

Figure 23A:
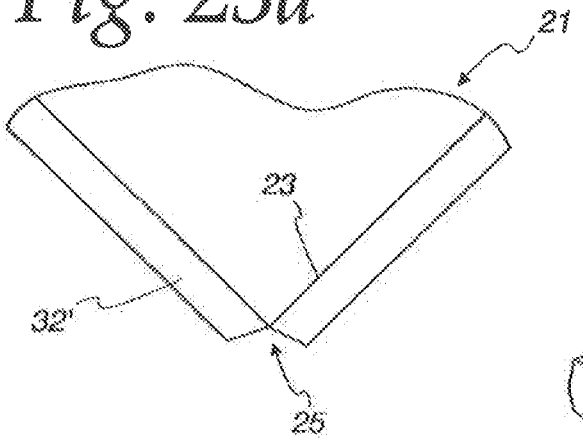
FIG. 23*a* is a partial isometric view of a material blank for use as a cover with the present invention, shown with fold lines on adjacent edges and an obtuse angle cutout at one corner.
Figure 23B:
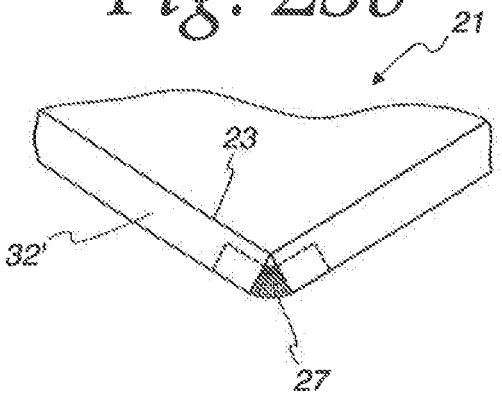
FIG. 23*b* is similar to FIG. 23*a* but illustrating an elastic material joining the strips defined by the fold lines and bridging the cutout.

The side panels 32 and 34 may be formed as a continuous side panel or multiple separate side panels. These side panels 32 and 34 can be formed from the same or different material as the horizontal panels 24 and 26 and can be at least partially formed by the horizontal panels 24 and 26. In addition, side panels 32 and 34 may also be formed by less labor-intensive methods, as illustrated in FIGS. 23*a*-23*b* and FIGS. 24*a*-24*c*. The methods illustrated in these figures, reduce the amount of sewing and thus the labor involved. For simplicity, only one cover 20 is described and illustrated. Referring first to FIGS. 23*a* and 23*b*, one corner of a cover blank, generally identified with the reference numeral 21, is illustrated for simplicity. The cover blank may be formed as a generally rectangular piece of material with fold lines, generally identified with the reference numeral 23, adjacent to each edge of the piece of material. As shown in FIG. 23*a*, a piece of material is cut out of each corner defining, for example, an obtuse angle. The cutout is identified with the reference numeral 25. The bands 32' are folded down as shown in FIG. 23*b*. A piece of flexible material, such as elastic, identified with the reference number 27, is used to bridge the cutout 25. The flexible material 27 is secured to the ends of the contiguous bands 32'. As will be appreciated by those of ordinary skill in the art, the embodiment illustrated in FIGS. 23*a* and 23*b* significantly reduces the labor costs.

Figure 24A:
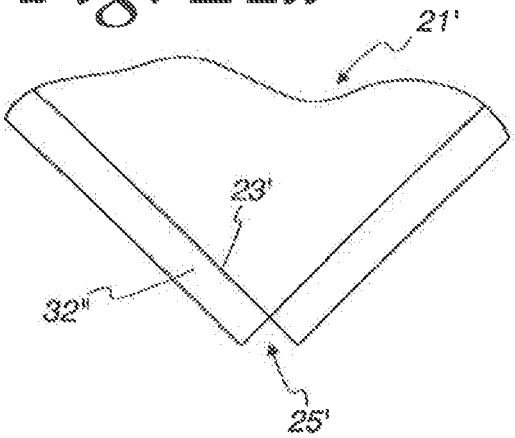
FIG. 24*a* is similar to FIG. 24*a* but illustrates a cutout at other than an obtuse angle.
Figure 24B:
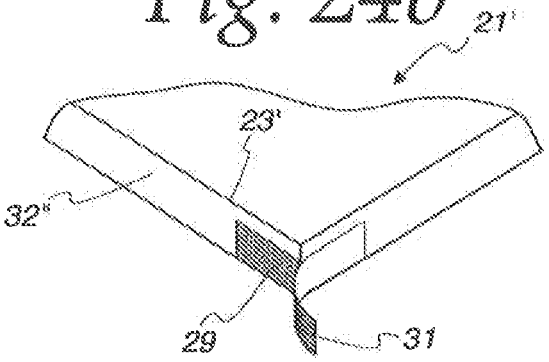
FIG. 24*b* illustrates the material blank illustrated in FIG. 24*a* with an integrated fastener strip on the strips defined by the fold lines shown with a cooperating removable fastener strip partially attached to the integrated fastener strip.
Figure 24C:
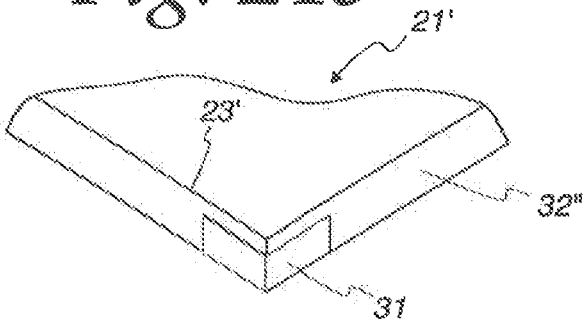
FIG. 24*c* is similar to FIG. 24*b* but shown with the cooperating removable fastener strip completely attached to the integrated fastener strip.

A second technique to reduce labor costs is illustrated in FIGS. 24*a*-24*c*. In this embodiment, the corners of the material blank 21' are cut to form a cutout 25' that is not an obtuse angle. The exemplary cutout 25' is shown at roughly a 90 degree angle. In this embodiment, a fastener strip 29 is affixed to each end of the band 32", adjacent the cutout 25'. A cooperating removable fastener strip 31 may be attached to the fastener strips 29 to secure the adjacent bands 32" together. The fastener strips 29 and 31 may be Velcro or other type of fastener. The embodiment illustrated in FIGS. 24*a*-24*c* allows the material blank 21' to be juxtaposed over the mattress 28 or box spring 30 with the removable fastener strips 31, as least partially removed, for example, as shown in FIG. 24*b*, and secured to the exposed cooperating fastener strip 29, once the cover 20 is in place, as shown in FIG. 24*c*.

In accordance with an important aspect of the invention, one cover 20, 22 has a "slick" side having a relatively low co-efficient of friction and a non-slick side having a relatively higher co-efficient of friction. The other cover 20, 22 has at least one slick side and may have two slick sides. As such, when the slick surfaces of the two covers 20, 22 are selectively placed in contact with each other, the mattress 28 can be rotated in a horizontal plane with minimal effort by one person in a configuration defining a rotate mode of operation, as discussed in more detail below. The non-slick side is used to selectively be placed in contact with an uncovered surface of the mattress 28 or an uncovered surface of the box spring 30 or platform or bed skirt. The non-slick side provides a relatively high co-efficient of friction when in contact with either an uncovered surface of the box spring 30 or an uncovered surface of the mattress 28 or bed skirt (FIG. 6) or platform (FIG. 12) in order to reduce if not prevent unintended rotation of the mattress in a normal configuration.

Referring to FIG. 4, a first cover 20 is attached to the underside mattress 28 so that its non-slick side is in contact with the mattress 28 and its slick side is facing downwardly. Similarly, the cover 22 is attached to the box spring 30 so that its non-slick side is in contact with the box spring 30 and its slick side is facing upwardly. Alternatively, the covers 20, 22 may be provided with two slick sides In such an embodiment, one slick side is in contact with the mattress 28, box spring 30, respectively, and the other slick side is facing downwardly or upwardly, respectively.

When the mattress 28 is then brought into contact with the box spring 30, as generally illustrated in FIG. 5, the slick sides of the covers 20 and 22 will be in contact with each other, enabling the mattress 28 to be rotated in a horizontal position with reduced effort by a single person defining a rotate mode of operation.

Once the mattress 28 has been rotated and is in the desired position, the top cover 20 may be detached from the mattress 28 and attached to the box spring 30 over the cover 22. This places the non-slick side of the cover 20 in contact with an uncovered surface of the mattress 28, thereby reducing unintended rotation of the mattress 28 with respect to the box spring 30. In this configuration, both covers 20 and 22 are attached to the box spring 30. Alternatively, in embodiments in which each of the covers has a slick side and a non-slick side, once the mattress 28 is in the desired position, the bottom cover 22 can be detached from the box spring 30 and attached to the mattress 28 over the cover 20, exposing the non-slick side of the cover 22 to the box spring 30. In this configuration, both covers 20 and 22 are attached to the mattress 30.

Two Cover Bed Skirt Application

Figure 6:
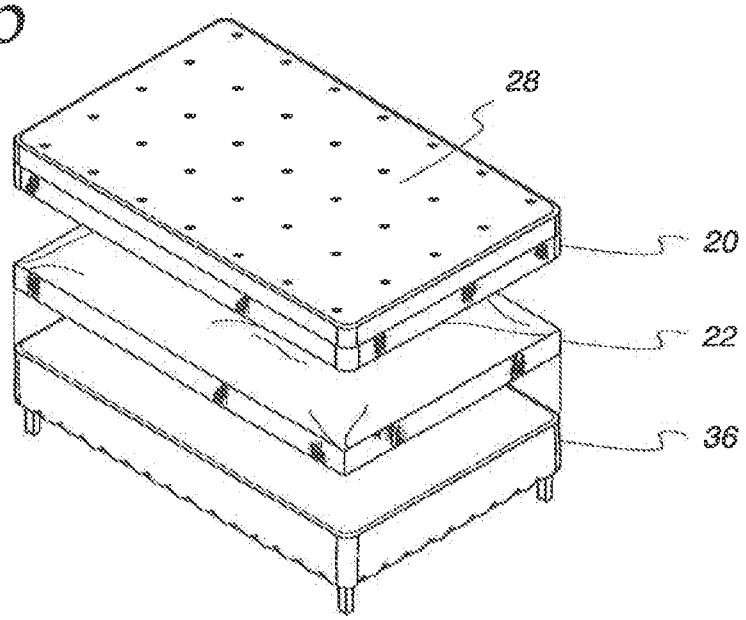
FIG. 6 is an exploded isometric view of an application of the invention illustrated in FIGS. 3-5 in which the bottom cover is to be placed over a bed skirt to secure the bed skirt with respect to the sides of the foundation.
Figure 7:
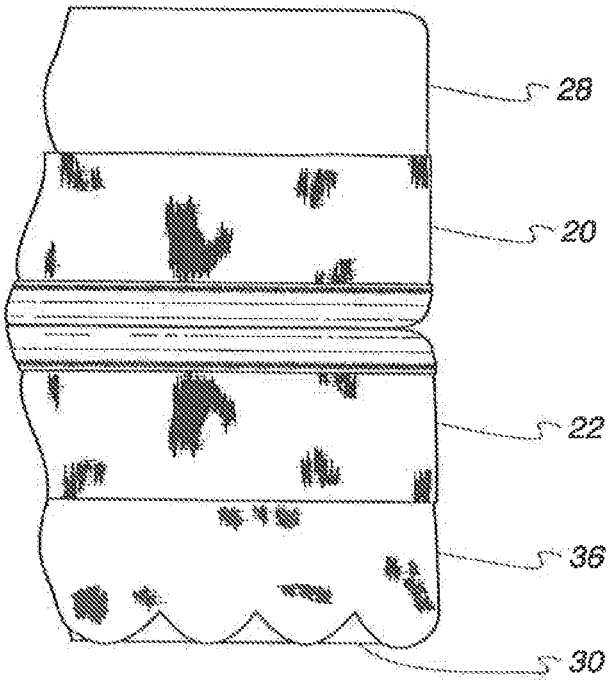
FIG. 7 is a partial side elevational view of the embodiment illustrated in FIG. 6, shown with one of the covers installed on the mattress and the other cover installed over the bed skirt on the foundation illustrating a rotate configuration in which both slick surfaces are in contact with each other while the bed skirt is held in place.
Figure 8:
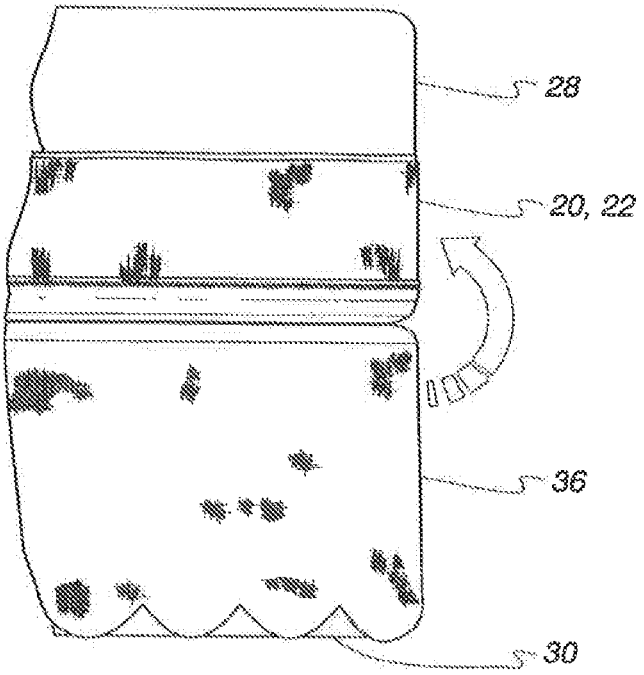
FIG. 8 is similar to FIG. 7 but shown with both covers installed on the mattress, illustrating a normal configuration in which a non-slick surface of the bottom cover is in contact with the surface of the bed skirt.

FIGS. 6-8 illustrate operation of the covers 20 and 22 in an application in which a bed skirt 36 is draped over the box spring 30, as generally shown in FIG. 6. Heretofore rotation of a mattress 28 with a bed skirt 36 draped over the box spring 30 was a relatively cumbersome task. The present invention greatly simplifies rotation of the mattress 28 in such an application while keeping the bed skirt 36 in place.

More specifically, in this application, the first cover 20 is attached to the underside of the mattress 28 so that its slick side is facing downward and its non-slick side (or alternatively its second slick side) is in contact with the mattress 28. The second cover 22 is attached to the box spring 30 over the bed skirt 36 so that its non-slick side is in contact with the bed skirt 36 and its slick side is facing upward, thereby placing the slick sides of the covers 20 and 22 in contact with each other, as shown in FIG. 7. The mattress 28 can then be rotated with reduced effort, as generally illustrated in FIG. 12.

After the mattress 28 is rotated to the desired position, the cover 22 is detached from the box spring 30 and attached to the mattress 28 over the cover 20, as shown in FIG. 8. This places the non-slick side of the cover 22 in contact with the bed skirt 36 to reduce if not prevent unintended rotation of the mattress 28. As shown in FIG. 8, the bed skirt 36 is uncovered and undisturbed since the cover 22 holds the bed skirt 36 in place during the rotation of the mattress 28.

Figure 9:
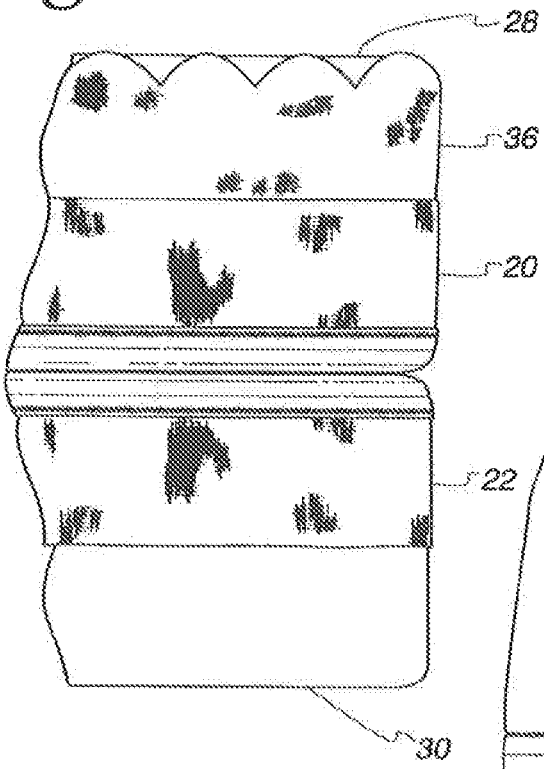
FIG. 9 is an alternative application of the embodiment illustrated in FIGS. 6-8 in which the bed skirt is used to hide both covers in a normal configuration, shown in a rotation configuration.
Figure 10:
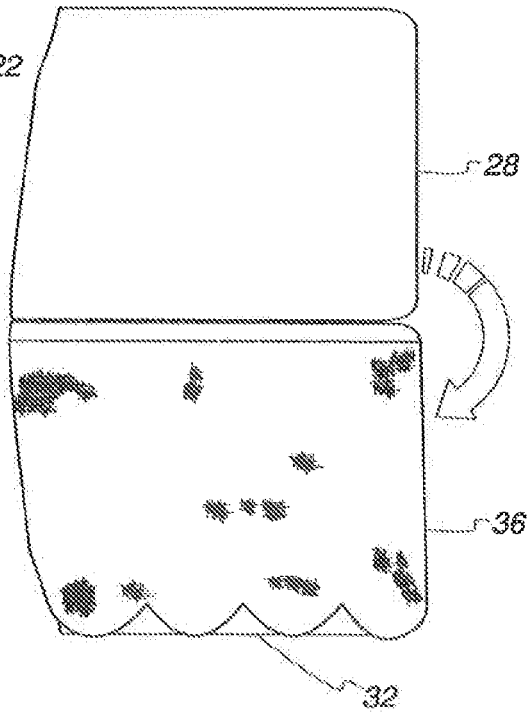
FIG. 10 is a partial elevational view of the application illustrated in FIG. 9 in a normal configuration in which the bed skirt is pulled down over the foundation hiding both of the covers.
Figure 11:
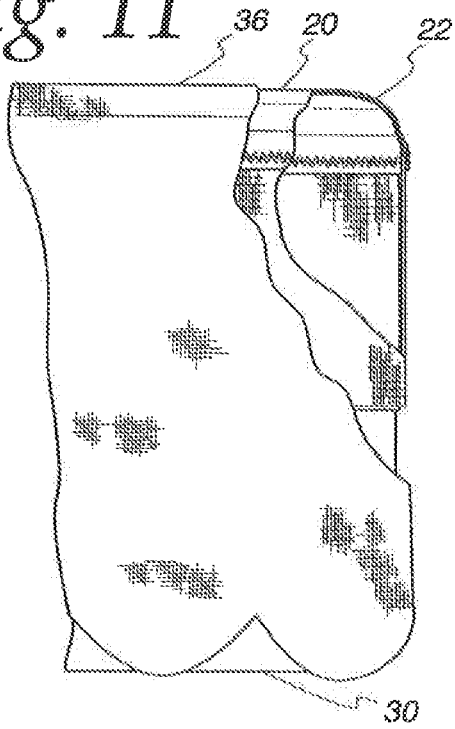
FIG. 11 is a partial elevational view of the box spring illustrated in FIG. 10, partially in section, shown in a normal configuration.

FIGS. 9-11 are similar to FIGS. 6-8 and illustrate another application in which the bed skirt is used to hide the first and second covers 20 and 22 in a normal configuration. Referring to FIG. 9, the bed skirt 36 is disposed around the mattress 28 so that its finished side is in contact with the mattress 28 and its unfinished side is facing outwardly. The first cover 20 is attached to the mattress 28 over the bed skirt 36 so that its non-slick side is in contact with the bed skirt 36 and its slick side is facing downwardly. The second cover 22 is attached to the box spring 30 so that its non-slick side is in contact with the box spring 30 and its slick side is facing upwardly, thus placing the slick sides of the first and second covers 20 and 22 in contact with each other. The mattress 28 can then be rotated in a horizontal plane virtually effortlessly by one person. Once the mattress 28 is in the desired position, the first cover 20 is detached from the mattress 28 and attached to the box spring 30, over the second cover 22, as shown in FIGS. 10 and 11. This places the non-slick side of the first cover 20 in contact with the mattress 28, thereby reducing unintended rotation of the mattress 28. Once the first cover 20 is attached to the box spring 30, the bed skirt 36 is folded down over the box spring 30, thereby hiding both the first and second covers 20 and 22, as shown in FIGS. 10 and 11.

Protective Cover

FIGS. 21 and 22 illustrate an embodiment in which the first cover is replaced with a protective cover 40, such as a protective cover, that encapsulates the mattress 28. The protective cover 40 is to size and shape of the mattress 28 to provide a relatively snug fit. An opening 42 is provided along one edge of the protective cover 40 to enable the mattress 28 to be placed inside the protective cover 40. A conventional fastener, such as a zipper 44 may be used to close the opening 42. In this embodiment, one surface 46 of the cover 40 is provided with a slick surface 46. The mattress 28 and cover 40 is configured so that the slick surface 46 faces the box spring 30. The slick surface 46 of the cover 40 cooperates with the cover 22 attached to the box spring 30 to facilitate rotation of the covered mattress 28 in a rotate mode. The cover 22 is as described above with a slick surface and a non-slick surface. More particularly, in a rotate mode of operation, the cover 22 is attached to the box spring 30 so that its non-slick surface is in contact with the box spring 30 and the slick surface faces upwardly in order to contact the slick surface of the protective cover 40. In this mode, the mattress 28 can be rotated with reduced effort in a horizontal plane. Once the mattress 28 has been rotated to the desired position, the cover 22 is attached to the mattress 28 causing its non-slick surface to be in contact with the box spring 30.

Coverless Embodiment

Figure 13:
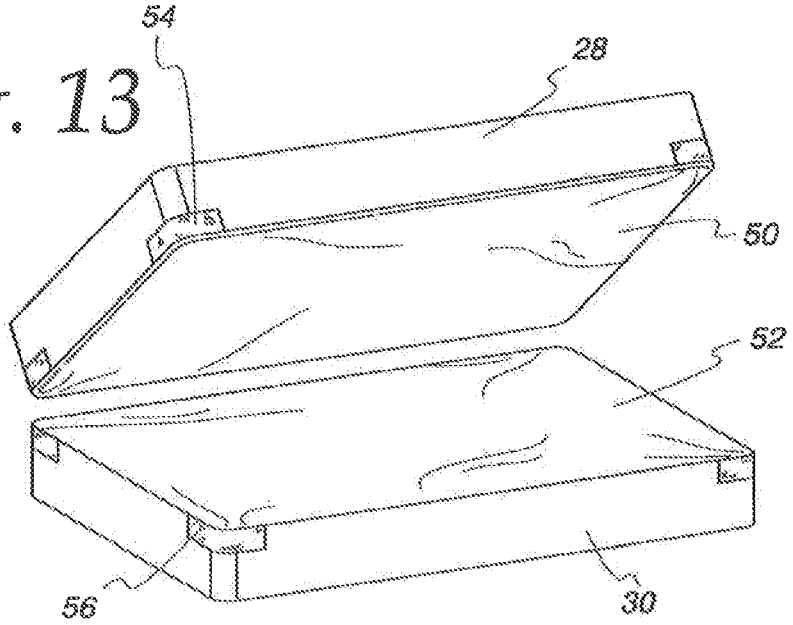
FIG. 13 is an alternate embodiment of the invention in which slick surfaces are integrated into the mattress and box spring, shown with the mattress removed from the box spring and fastener strips integrated into the corners of the mattress and foundation.

The embodiments discussed above are based on the use of one or more covers which can be selectively configured in a rotate mode of operation or alternatively a normal mode of operation. In the embodiments illustrated in FIGS. 13-20, there are no covers. In these embodiments, slick surfaces 50 and 52 are integrally provided on the mattress 28 and box spring 30, respectively. In particular, as best shown in FIG. 13, the mattress 28 is formed with an integral slick surface 50 on it is underside. Similarly, the box spring 30 can be formed with integral slick surface 52 facing upwardly. As such, when the mattress 28 is properly placed on the box spring 30, the slick surfaces 50 and 52 are in contact with each other. In such a configuration, the mattress 28 can be freely rotated with respect to the box spring 30.

Figure 14:
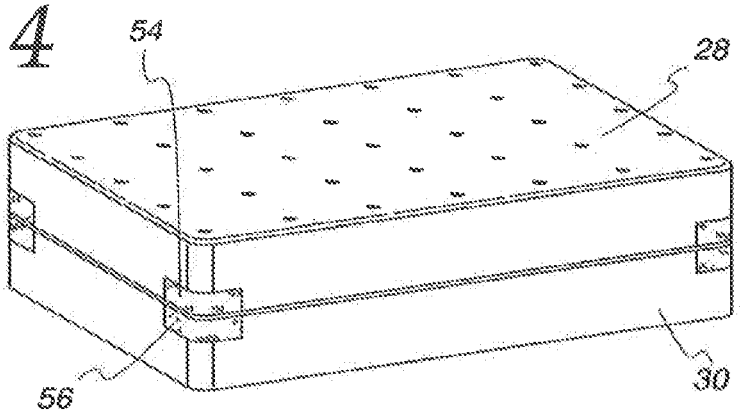
FIG. 14 is similar to FIG. 13 but shown with the mattress placed on the foundation illustrating integrated fastener strips aligned with one another.
Figure 15:
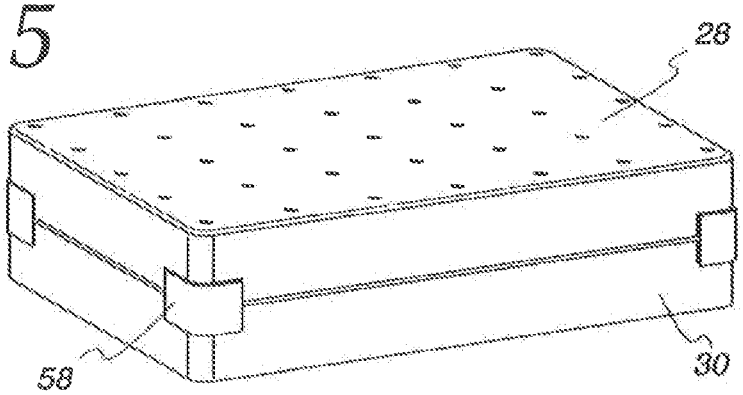
FIG. 15 is similar to FIG. 14, illustrating cooperating removable fastener strips attached to the integrated fastener strips in order to secure the mattress to the foundation.
Figure 16:
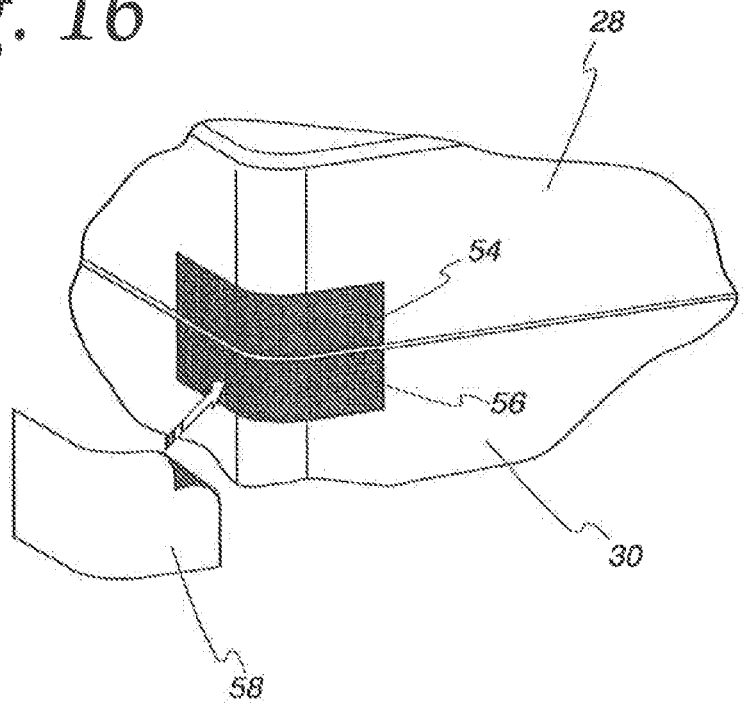
FIG. 16 is a partial elevational view illustrating one corner of a mattress disposed on a foundation illustrating integrated fastener strips aligned on each corner of the foundation and mattress, shown with a cooperating removable fastener strip removed.
Figure 17:
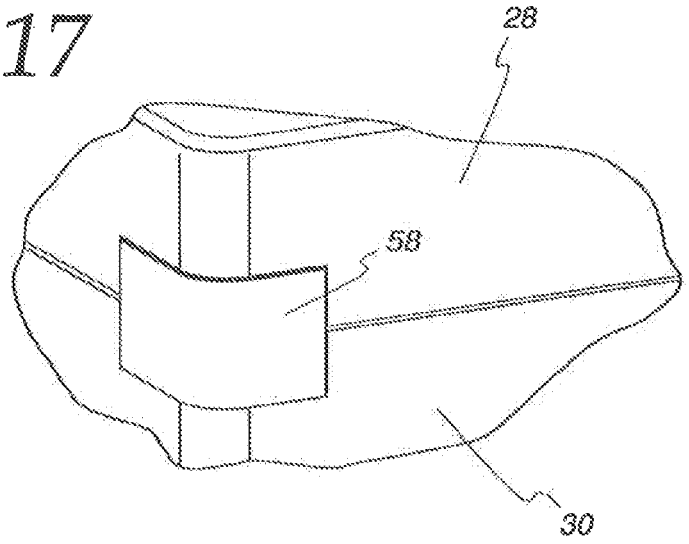
FIG. 17 is similar to FIG. 16 but shown with the cooperating removable fastener strip attached to the integrated fastener strips on the mattress and foundation.

In order to prevent movement of the mattress 28 with respect to the box spring 30 in a normal mode of operation, fastener systems, for example, Velcro fasteners may be provided on the corners of both the mattress 28 and the box spring 30. In particular, permanent fastener strips 54 are provided on the corners of the mattress 28, as shown in FIGS. 13, 14 and 16. Similarly, permanent fastener strips 56 are provided on the corners of the box spring 30. As shown in FIGS. 13, 4 and 16, when the mattress 28 is correctly aligned with the box spring 30, the permanent fastener strips 54 are aligned with the permanent fastener strips 56. In order to secure the mattress 28 relative to the box spring 30, removable cooperating fastener strips 58 are selectively attached to the permanent fastener strips 54 and 56 as shown in FIGS. 15 and 17 defining a normal mode of operation. The removable fastener strips 58 are simply removed in order to rotate the mattress 28 and replaced once the mattress 28 has been rotated.

Figure 18:
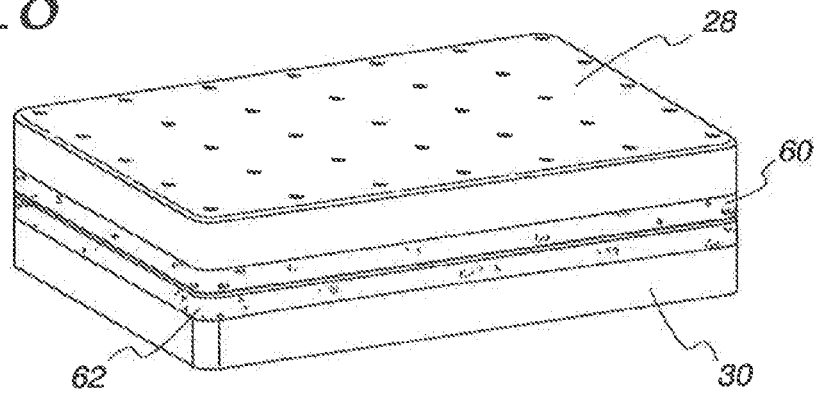
FIG. 18 is an isometric view of an alternative fastener configuration for securing a mattress to a foundation, illustrating a mattress disposed on the foundation in which the integrated fastener is disposed around the periphery of the foundation and the mattress.
Figure 19:
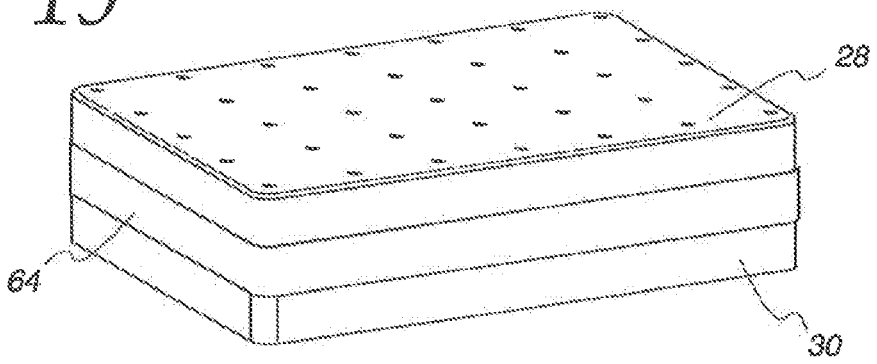
FIG. 19 is similar to FIG. 18 but shown with a cooperating removable fastener strip attached to the integrated fastener strips on the mattress and the foundation.
Figure 20:
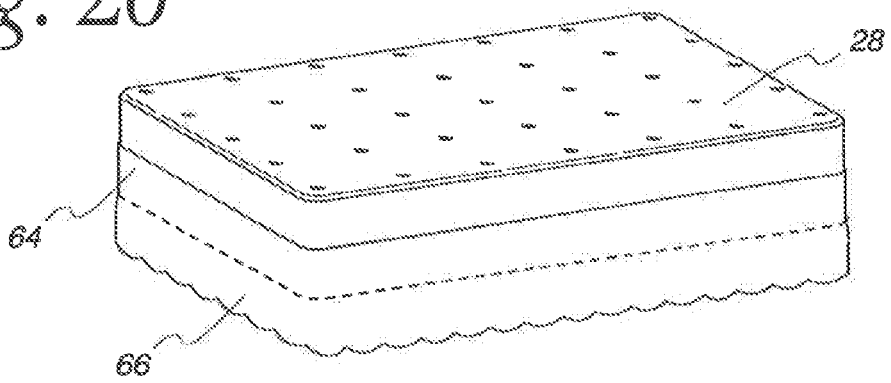
FIG. 20 is similar to FIG. 19 but illustrating a bed skirt which incorporates a removable fastening strip attached to the integrated fastening strips on the mattress and foundation.

Two alternate embodiments are illustrated in FIGS. 18-20. In the embodiment illustrated in FIGS. 18 and 19, permanent fastener strips 60 and 62 are located around the peripheries of the mattress 28 and the box spring 30, adjacent to the edges where the mattress 28 and the box spring 30 come together, as shown in FIG. 18. As shown in FIG. 19, a cooperating removable fastener strip 64 is attached to the permanent fastener strips 60 and 62 on the mattress 28 and box spring 30, respectively. In yet another alternate embodiment as shown in FIG. 20, the cooperating removable fastener strip 64 may be affixed to the inside of a bed skirt 66. With such a configuration, not only are the mattress 28 and box spring 30 secured together, the configuration also allows a bed skirt 66 to be easily installed.

Cover Materials

In addition to the above, all of the horizontal panels as well as the side panels can be made from both stretchable and non-stretchable materials, such as cloth, and other materials that are bendable and amenable to being folded and stored in relatively small packages. The material for one cover 20, 22 need only have a slick surface on one side and a non-slick surface on an opposing side. The non-slick surface can be created on one side of a suck material by way of a coating or sewing or fusing a non-slick backing to one side of the non-slick material. Various conventionally available materials are suitable for the cover having a slick side and a non-slick side. For example, "20 Denier Heat Sealable (backside) 100% Nylon Rip Stop" material is suitable for use with the present invention or other materials with similar coefficients of friction on the slick and non-slick sides. Such material may be nylon, for example, 100% nylon with a coating on one side, for example, urethane or other thermal plastic or heat sealable coating Such nylon rip stop material is known to come in widths of 58-62 inches wide and weighs about 1.9 to 4.4 ounces per square yard. Such material can easily be pieced together to accommodate various mattress widths if necessary.

Nylon rip stop material suitable for use with the—present invention is available from various sources, such as, Quest Outfitters of Sarasota, Fla. (http://questoutfitters.com). Their nylon taffeta material is described in detail at http://questoutfitters.com/coated.html#HEAT_SEALABLE, hereby incorporated by reference. Suitable nylon taffeta material is also available from Rockywoods in Loveland, Colo. (http://www.rockywoods.com). Their nylon taffeta material is described in detail at http://www.rockywoods.com/Fabrics-Hardware-Patterns-Kits/Medium-Weight-Nylon-Fabrics/Heat-Sealable-70-Denier-Nylon-Taffeta, hereby incorporated by reference.

Non-woven materials may also be used for the cover 20, 22 having a slick side and a non-slick side. For example, Tyvek® polyethylene non-woven fabric, as manufactured by the DuPont Corporation and described in detail at http://www.2.dupont.com/Products_and_Services/en_VN/nwn.html may be used. Other materials having two slick sides can also be used, such as, silicone impregnated nylon rip stop, for example, as available from Seattle Fabrics. Inc., http://www.seattlefabrics.com/nylons.html. Other materials can also be used with a coating applied to one side. Moreover, different materials can be used for each cover in an application.

The above materials relate to single ply materials in which a single sheet of material is used for the cover. The cover may be formed from a relatively slick material forming a slick surface on one side. The other side of such a cover may be coated with a non-slick coating material to form a non-slick side. Alternately, a single sheet of a relatively non-slick material forming a non-slick surface on one side and coated on an opposing side with a slick coating material to form a slick surface. Alternately, the cover in accordance with the invention can be formed from a single sheet of material and coated with a slick material on one side and coated with a non-slick material on an opposing side.

Obviously, many modifications and variations of the present invention are possible in light of the above teachings. For example, materials for the covers and slick surfaces other than those mentioned above can be which have similar co-efficient of friction characteristics. Thus, it is to be understood that, within the scope of the appended claims, the invention may be practiced otherwise than as specifically described above.

What is claimed is:

1. A cover that can be used to facilitate the rotation of a mattress supported by a box spring or platform, the cover comprising:

a horizontal panel having a first side and an opposing side, the first side including a slick surface, the horizontal panel being configured to be disposed between an underside of said mattress and a top side of said box spring or platform;

an attachment device for securing the horizontal panel relative to the mattress or alternatively to the box spring or platform, wherein in a normal mode of operation, the attachment device secures the horizontal panel relative to one of said underside of said mattress or the top side of said box spring or platform to prevent rotation of said mattress, and in a rotate mode of operation, the attachment device secures the piece of material to an other of said underside of said mattress or the top side of said box spring or platform to enable the mattress to rotate with respect to the box spring or platform.

2. The cover as recited in claim 1, wherein the opposing side has a non-slick surface.

3. The cover as recited in claim 1, wherein the attachment device is at least partially formed from the same material as said horizontal panel.

4. The cover as recited in claim 1, wherein the attachment device is at least partially formed from a different material than said horizontal panel.

5. The cover as recited in claim 4, wherein said different material is at least partially formed from an elastic material.

6. The cover as recited in claim 1, wherein said horizontal panel is formed as a generally rectangular panel.

7. The cover as recited in claim 6 wherein said attachment device includes at least one band.

8. The cover as recited in claim 1 wherein said slick surface is at least partially surrounded by a non-slick surface.

9. The cover as recited in claim 1, wherein said attachment device includes one or more side panels, wherein a portion of the one or more side panels overlaps the horizontal panel on the opposing side.

10. The cover as recited in claim 1, wherein said attachment device includes an elastic band.

11. The cover as recited in claim 9, wherein both sides of the one or more side panels are formed with non-slick surfaces.

12. The cover as recited in claim 1, wherein said attachment device is formed as a continuous piece of material.

13. The cover as recited in claim 1, wherein said attachment device is discontinuous.

14. The cover as recited in claim 1, wherein the opposing side has a slick surface.

15. The cover as recited in claim 1, said horizontal panel is formed from a bendable material that has a slick surface on the first side and a non-slick surface on the opposing side.

16. The cover as recited in claim 15 wherein said horizontal panel is formed from cloth.

17. The cover as recited in claim 15, wherein said horizontal panel is not coated.

18. The cover as recited in claim 15, wherein said horizontal panel is coated.

19. A cover that can be used to facilitate the rotation of a mattress supported by a box spring or platform, said box spring or platform covered by a bed skirt, the cover comprising:

a horizontal panel having a first side and an opposing side, the first side including a slick surface, the horizontal panel being configured to be disposed between an underside of said mattress and a top side of a bed skirt covering said box spring or platform so that the first side of the horizontal panel is in contact with an underside of the mattress;

an attachment device for securing the horizontal panel relative to the mattress or alternatively to the bed skirt and the box spring or platform, wherein in a normal mode of operation, the attachment device secures the horizontal panel relative to the underside of the mattress to prevent unintended rotation of said mattress and in a rotate mode of operation, the attachment device secures the horizontal panel and the bed skirt to the top side of the box spring or platform to enable the mattress to rotate.

20. The cover as recited in claim 19, wherein the piece of material is a horizontal panel, and said attachment device includes one or more side panels, wherein a portion of the one or more side panels overlaps the horizontal panel on the opposing side.

* * * * *